United States Patent [19]

Ahejew

[11] 4,442,637

[45] Apr. 17, 1984

[54] SIMULTANEOUS DOUBLE-ACTING SPLIT ABRASIVE WHEEL FOR PERIPHERAL SHARPENING OF HELIX TOOLS AND USE THEREOF

[76] Inventor: Alexander Ahejew, 5082 E. Holland Rd., Saginaw, Mich. 48601

[21] Appl. No.: 296,030

[22] Filed: Aug. 25, 1981

Related U.S. Application Data

[63] Continuation of Ser. No. 24,380, Mar. 27, 1979, abandoned, which is a continuation-in-part of Ser. No. 864,005, Dec. 30, 1977, abandoned.

[51] Int. Cl.[3] ..... B24B 3/24; B24B 5/00

[52] U.S. Cl. ..... 51/288; 51/206 R; 51/209 R

[58] Field of Search ..... 51/206 R, 206 NF, 209 R, 51/288, 207, 206 P, 168

[56] References Cited

U.S. PATENT DOCUMENTS

| | | | |
|---|---|---|---|
| 1,415,879 | 5/1922 | Lacy | 51/288 |
| 2,201,410 | 5/1940 | Simonds | 51/209 R |
| 2,309,016 | 1/1943 | Ryan | 51/209 R |
| 2,541,873 | 2/1951 | Holman | 51/206 R X |
| 3,026,655 | 3/1962 | Osenberg | 51/209 R |
| 3,049,843 | 8/1962 | Christensen | 51/206 R |
| 3,162,187 | 12/1964 | Christensen | 51/206 R X |
| 3,885,925 | 5/1975 | Tatar | 51/288 X |

OTHER PUBLICATIONS

Diamond Wheel Catalog #72, Accurate Tool Corp., Hackensack, N.J., pp. 3 & 13, (9-18-72).

*Primary Examiner*—Frederick R. Schmidt
*Assistant Examiner*—Robert A. Rose
*Attorney, Agent, or Firm*—N. Jerome Rudy

[57] ABSTRACT

A simultaneously double-acting split abrasive grinding wheel for sharpening helix tools, such as end mill cutters, has in any embodiment thereof separate, spaced but adjacent and differently proportioned abrasive working strips therein to constitute its total peripheral surface; the wheel being adapted in its use to in single pass, one-step operation impart all at one grinding the requisite primary relief angles, secondary clearances and primary relief width spacings on the peripheral land surfaces of the tools being finished therewith.

50 Claims, 23 Drawing Figures

∢WT
+
∢TS
∢WT
∢WT
∢TN
∢"TN"
42
32
28
41
50
"WR"
31
∢"TS"
25c
30
25
54p
"TG"
54
"CE"
53
"HL"
"WT"
"TD"
51c
"N"
54s
"BP"
54s
53
51
"S"
"TM" &
"CDM"

"N"
51
52
"CE"
54
52
54p
"CDM"
54
"BP"
"HL"
54s
"S"
25c

"CE"
"N"
52
"HL"
54
54p
54s
"CDM"
52
54
"BP"
"S"
25c
51

71
"WTD"
72
27
65c
65
"WT"
72
31
30
"S"
"TTD"
54s
71
"N"
54p
54
"HL"
53
"TM"
"CDM"

"N"
65c
"TWT"
"G"
"BP"
"SBT"
"BBT"
32
54
52
31
"CE"
54s
"HL"
42
65
28
30
"TG-III" & or "I"
"TG-II"
53
41
"WTD"
52
51
"TM"
"CDM"
"S"
25c
51c
71
72

SIMULTANEOUS DOUBLE-ACTING SPLIT ABRASIVE WHEEL FOR PERIPHERAL SHARPENING OF HELIX TOOLS AND USE THEREOF

CROSS REFERENCES TO RELATED APPLICATIONS

This application is a continuation of identically-entitled Application for U.S. Letters Patent, herewith abandoned, having Ser. No. 06/024,380, filed Mar. 27, 1979, now abandoned, which in turn was a continuation-in-part of copending (and also abandoned) Application for U.S. Letters Patent on "SELF DOUBLE BACK OFF FROM ABRASIVE WHEELS AND DIAMOND WHEELS" having Ser. No. 864,005 which was filed Dec. 30, 1977.

BACKGROUND OF THE INVENTION

The idea of using abrasive wheels for sharpening by means of grinding of helix tools (such as end mill cutters and the like) is not new. Perforce, very hard materials are used to constitute the abrasive component of such wheels including, for example, dust, chips or other pulverizations of natural and synthetic diamond forms, crushed silicon carbide (i.e., "Carborundum") and so forth.

The problem and significant operational draw-back in conventional practices and operations for helix tool sharpening by abrasive wheel grinding is that generally at least a two-step or -stage operation involving separate grinding set-ups and manipulations is required for completion of the procedure. By the usual means (as is hereinafter more thoroughly described), the peripheral land portion on the teeth of the tool being sharpened is sequentially removed from the "blank" or "stock" form being in process by generally at least two independent grindings done most commonly in a "back off" (sic) style of material removal with respect to the intended cutting edge(s) of the tool teeth. In this way, there is provided to the peripheral land of the end mill or the like being sharpened the necessary primary relief (and width of the primary relief land portion) and secondary clearance which must be achieved for satisfactory finished tool provision.

Helix tools sharpened without secondary clearance characteristics are generally not as desirable or effective as those having such features. Without any (or insufficient) secondary clearance, chip removal and heat-dissipating characteristics of the cutting tool are usually less than desired and, in many instances, due to having to employ excessive primary relief angles, there is an increased likelihood of encountering "chatter" in use of the tool on account of the insufficiently strong cutting edges resulting from too large primary relief angle constructions gotten into when no secondary clearances are involved.

As is evident, the two-stage grinding operation is less than ultimately efficient and requires considerable time and labor for, firstly, setting the work up for the primary relief making then, secondly and redundantly, re-setting the work up for the secondary clearance and associated primary relief width implementations and provisions. Needless to mention, it would be desirable to have economies capable of realization in the relatively cumbersome conventional practice of helix tool sharpening using abrasive wheels for the purpose while, at the same time, enabling the manufacture by a reliable and readily reproducible simplified process of at least equivalent if not superior quality sharpened products.

Representative prior art in the area of the present invention includes U.S. Pat. Nos.: (i) 2,396,505 (to C. Gumper); (ii) 3,049,843 (to F. L. Christensen—I); and 3,162,187 (to the same F. L. Christensen—II). These involve merely grinding wheel arrangements for surface finishing of such soft materials as rubber (as in the Gumper Patent) and/or abrasively-fitted circular saw blades for cutting through, and not surface finishing, bodies of such materials as concrete, marble and other natural stones, ceramics and so forth (as in Christensen I and II).

However, there is complete lack and literally nothing in prior art concerned with, teaching or leading to, in connection with the concept of abrasive wheels for helix tool sharpening: the achievement and provision of an advantageous and beneficial simultaneously double-acting split abrasive wheel for efficiently, effectively and most expediently sharpening such tools in a single operation imparting primary relief angles as wanted and needed, secondary clearances of the most advantageous and desired sort and most appropriately wide primary relief land surfaces; which wheel in any embodied form thereof is readily made, easily and accurately used with minimized attention and care needed for its operation and capable of giving excellent result reproducability and consistency in and for the sharpening of pluralities of tools in process; all with excellent durability and unusual wearability in and of the wheel adapting it for considerably prolonged usages without much need for re-dressing or discard and additionally, in toto, with the generally attractive and advantageous features of the sort and creation indigenous in the present contribution to the art.

FIELD AND PURVIEW OF THE INVENTION

This invention pertains, as an article of manufacture and its applied method usage as the same are hereinafter more fully defined and characterized, to a simple, durable, accurate and dependable (especially for facile and constant reproducibility of results in operational use), simultaneously double-acting, split abrasive wheel for one-step and single manipulation sharpening in a grinding operation of various helix tools comprised of spirally fluted cutting teeth projecting from the root portion of each wherein there is imparted in single composite tool finishing action the requisite and desired primary relief angle, secondary clearance and primary relief land width with associated close tolerance and excellence in the machining of each tool so treated, said wheel being adaptable to embodiments of several different specific forms and styles and having the here-delineated and represented features and particulars, which is attractively appealing and extraordinarily utile for the presently-indicated applications and purposes.

The primarily essential reason for and role of improved wheel devices in accordance with the present invention is, quite beneficially and with considerable practical, economic and labor- and energy-saving and -conserving consequence and advantage, to to provide a novel implement for better, quicker and more propitious grind-sharpening of helix tools therein providing best quality finished product at drastically reduced cost of manufacture taking all things and contributing factors into account.

The provision of all of the noted desiderata as above and in the foregoing brought forth, and even more and other benefits and advantages as will become more evident in the ensuing description and Specification, is and are amongst the principle aims, purposes and objectives of the present invention.

SUMMARY OF THE INVENTION

The present invention, and the discovery on which it is based, is relevant to and definitive of an extremely advantageous, effective and time- and cost-cutting and -saving sharpening appliance or device for dressing cutting tools, the said apparatus assembly comprising: a double-banded, split abrasive wheel (in either disk-like or cup-like embodiment form) for the sharpening by abrading grind dressing of helix tools (such as end mills and the like), said wheel being characterized in its unique adaptability and capability of accomplishing in a single, operation to impart completely in the peripheral surface of teeth flight(s) of the tool being sharpened the appropriate desired primary relief surface both as to width and angulation from the intended cutting edge of the tool and the appropriate desired secondary clearance surface leading to the heel of the tooth profile and broken away from and more highly angulated than said primary relief surface; said wheel having: a generally circular central support member with a round peripheral edge thereon that is spaced from and coaxial with the central axis center line of rotation of the wheel; a pair of constantly-layered, continuously-uninterrupted, equally- and uniformly-thick, split abrasive bands mounted side-by-side on the peripheral edge of said central support member and coaxial with said axial center line of said support member; each of said pair of abrasive bands having an exposed, continuous and integral grinding surface face thereon; each of said pair of abrasive bands having an independently and distinct uniform width, the determining side edges of which limit the grinding face(s) thereof; the grinding surface face of each of said abrasive bands lying in the same line and plane passing in crossing contact over said respective aligned faces of both bands; a gap of softer material including the material of said central support member separating and uniformly spacing said pair of split abrasive bands between one of the laterally-extending width edges of each thereof in the mounted placement position of said bands about said central support member; the width of the first one of said bands in said pair thereof which is intended and adapted to initially contact and form the cutting edge and provide material removal for primary relief from and into the teeth projection(s) of a helix tool being forwardly passed into contact for its sharpening by means of said wheel being relatively wider than the width of the relatively narrower second one of said bands of said pair thereof which is intended and adapted to immediately subsequently contact and cut secondary clearance relief and angulation after initial action by said first band on said tooth projection(s) of said helix tool.

The invention also contemplates the method and technique beneficially available in utilizing the herein-revealed and -described split abrasive grinding and sharpening wheel in and for the dressing of various helix tools needing such finishing preparation.

The embodying details and other significant specifics of the invention are also set forth in the following.

ILLUSTRATED EXEMPLIFICATION OF THE INVENTION

The invention is pictorially demonstrated in and by the twenty-four (24) views of the accompanying Drawing (all of which, for simplicity and convenience, are illustrated in a more-or-less schematic and/or fanciful manner of representation), wherein, as they are to be taken in conjunction with the Specification that follows.

Figure 4:
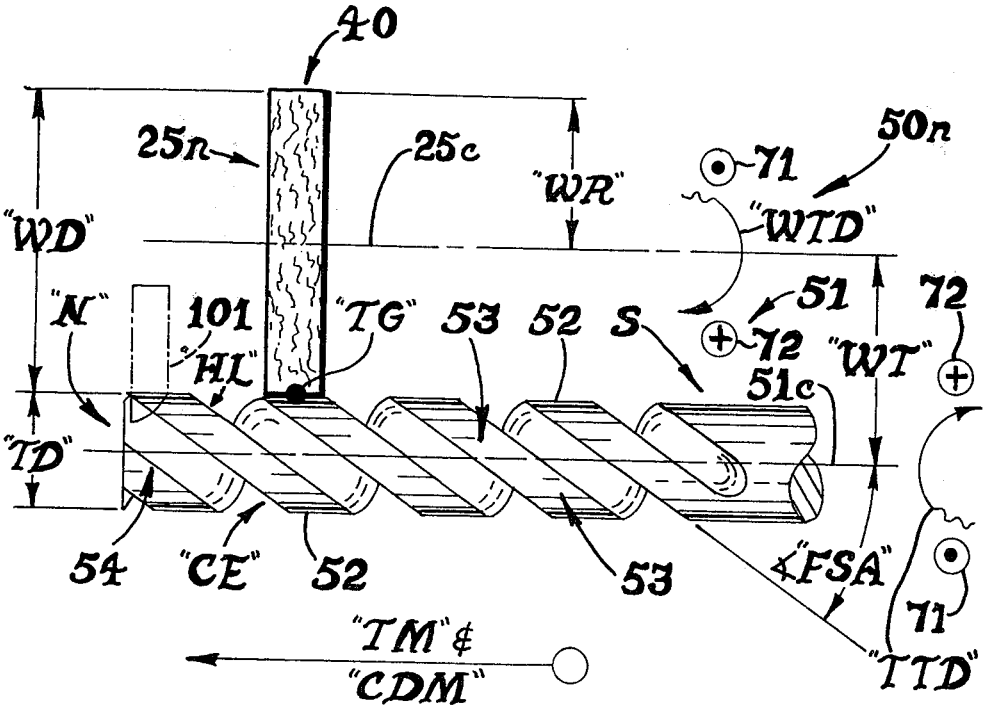
PRIOR ART Fig. 4
FIG. 4 is a side elevation view, fancifully represented, illustrating the assembly and operation of a conventional, one-piece and singly integral grinding wheel for sharpening in the manner heretofore known and employed a typical helix tool.
Figure 6:
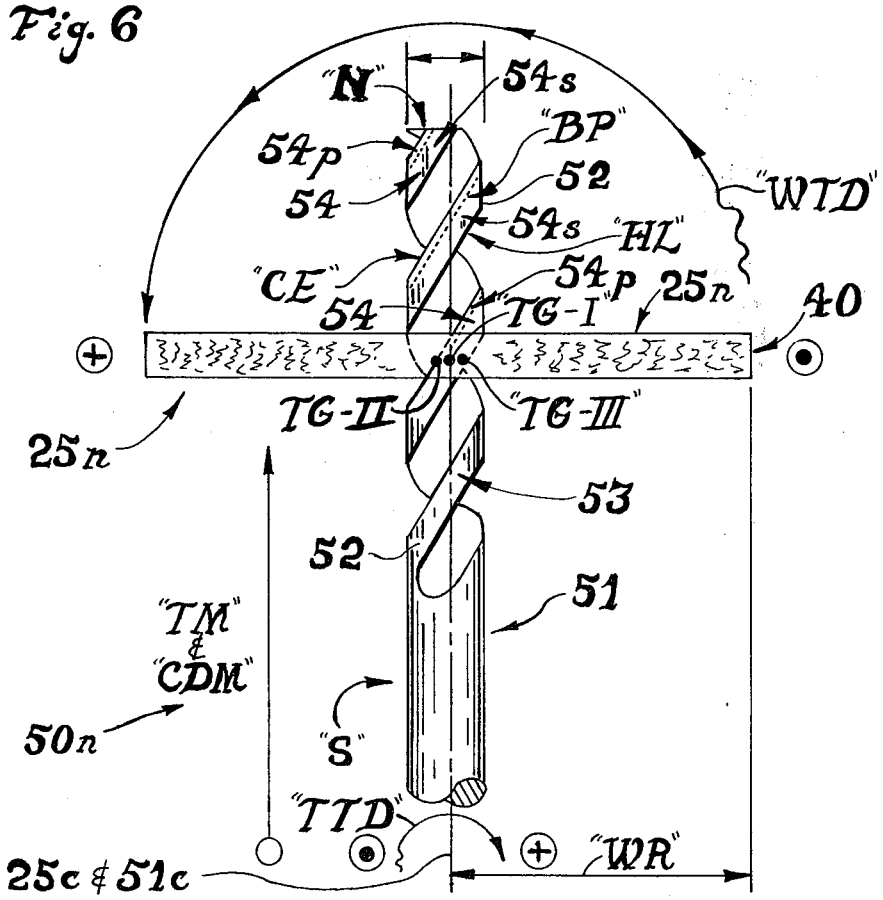
PRIOR ART Fig. 6
FIG. 6 is a top or plan view, partly in section and with fanciful representations therein, of a conventional grinding wheel in operation to sharpen an end mill and showing in the illustration various positioning points possible and necessary with respect to related wheel and tool disposition in order to effect and accomplish proper and requisite tool sharpening.
Figure 7:
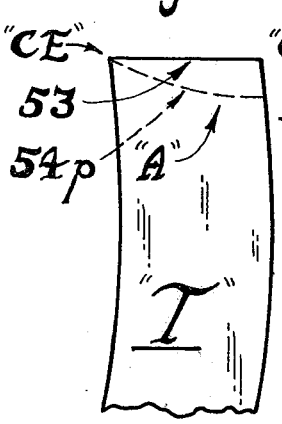
PRIOR ART Fig. 7
Figure 8:
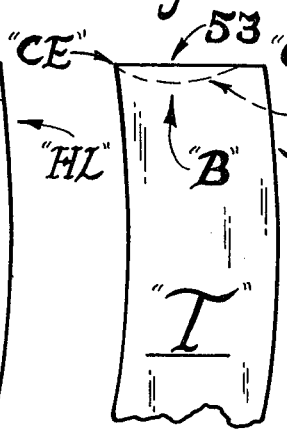
PRIOR ART Fig. 8
Figure 9:
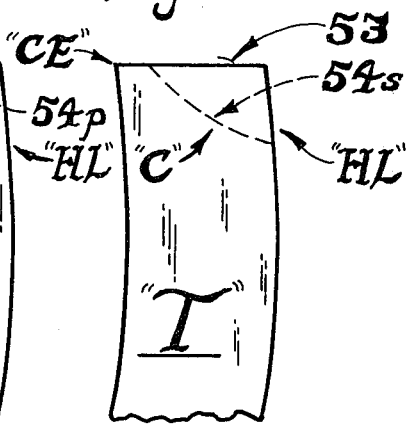
PRIOR ART Fig. 9
Figure 10:
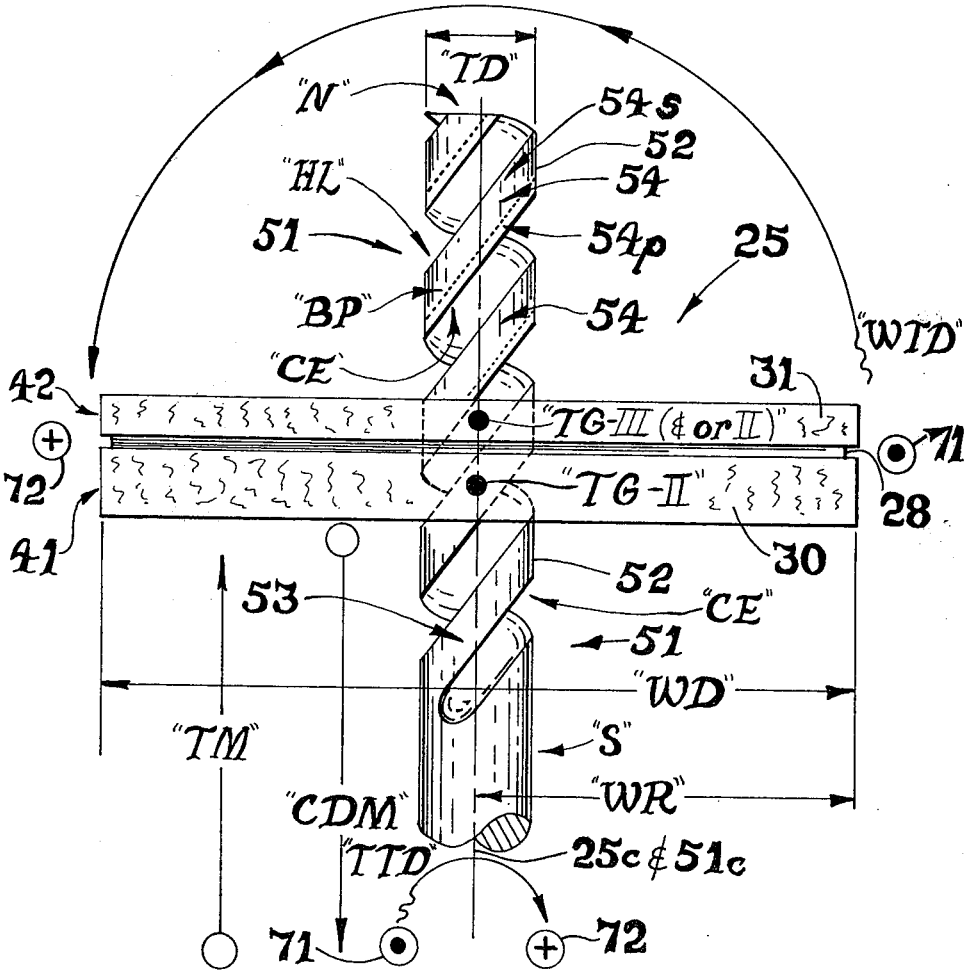
Figure 10A:
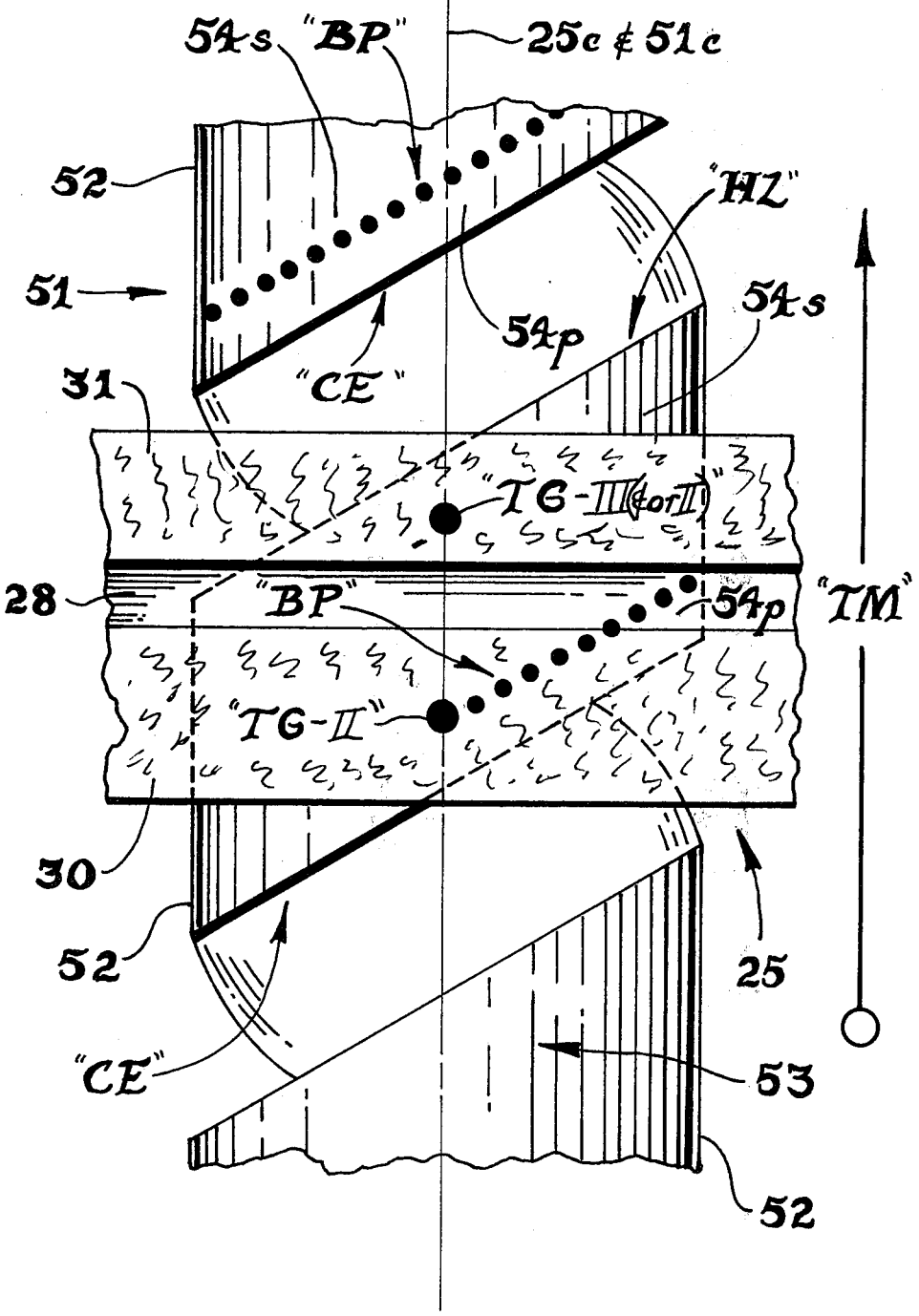
Figure 11:
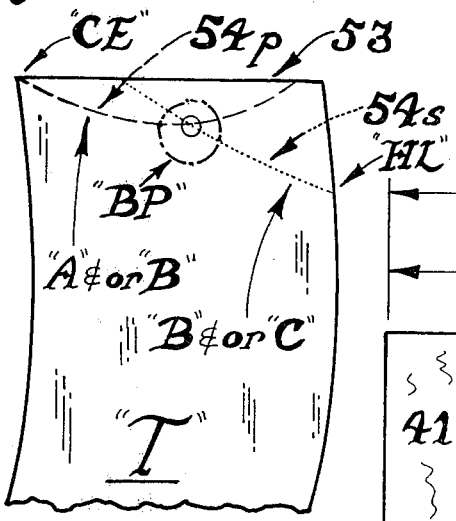
Figure 12:
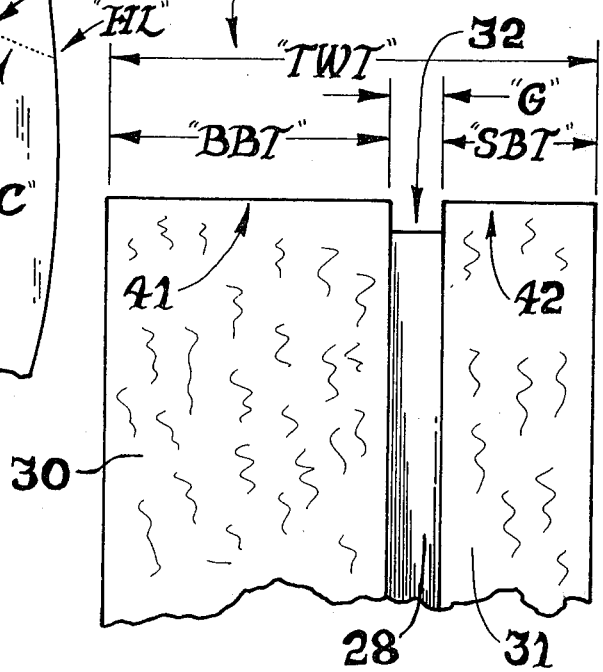
Figure 13:
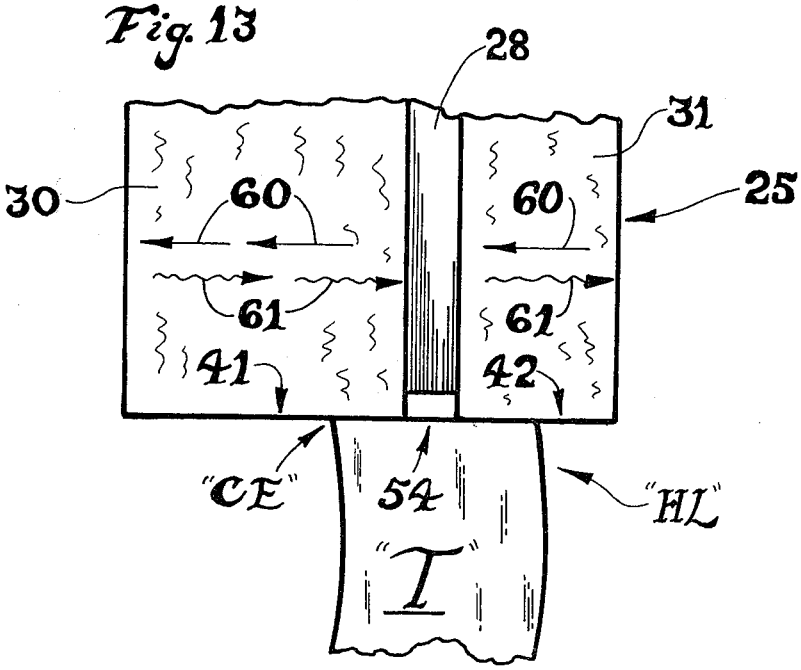
Figure 14:
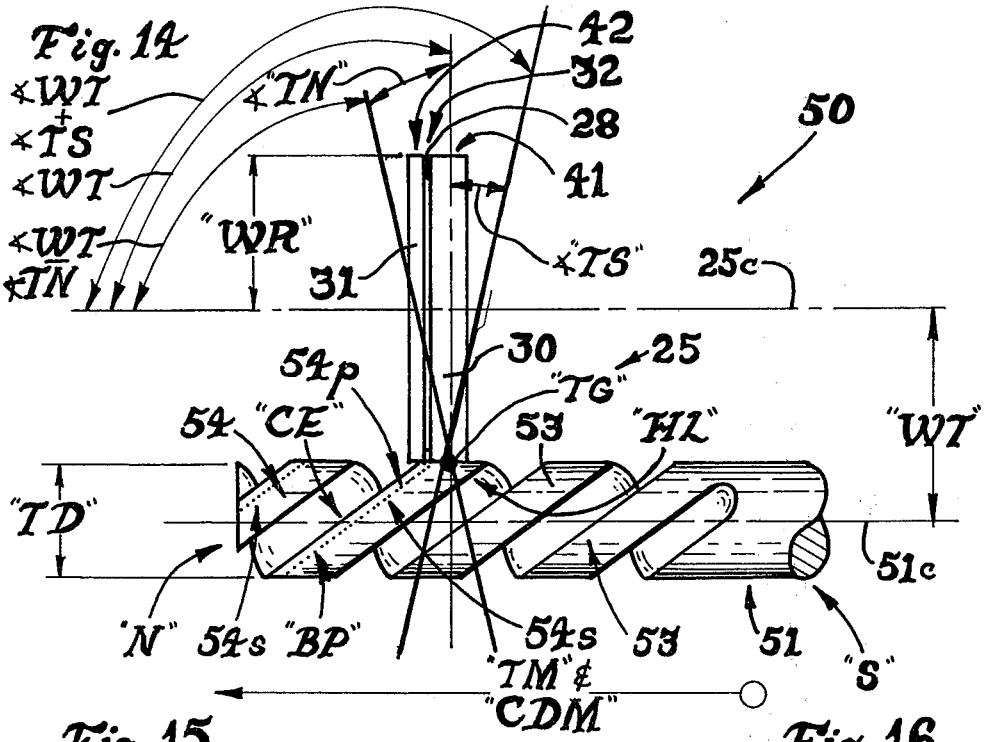
Figure 15:
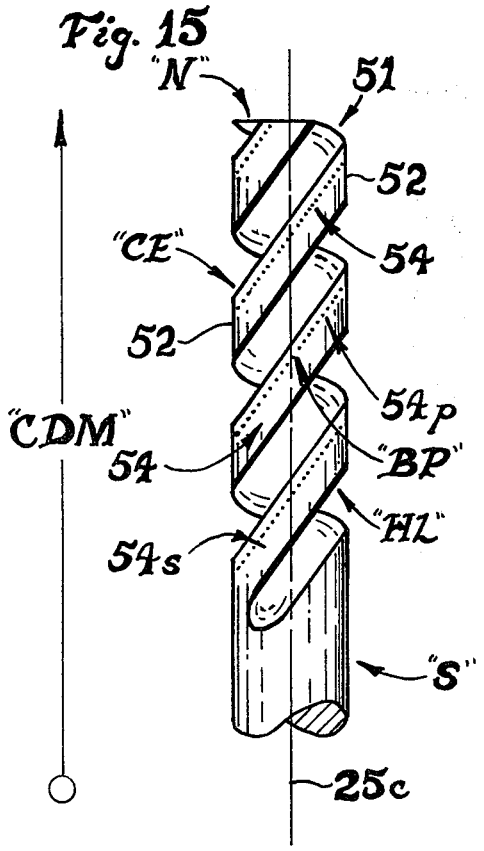
Figure 16:
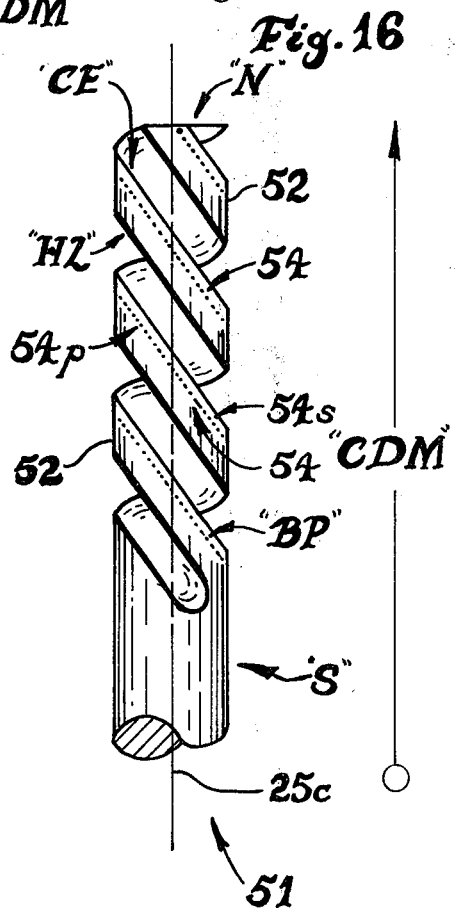
Figure 17:
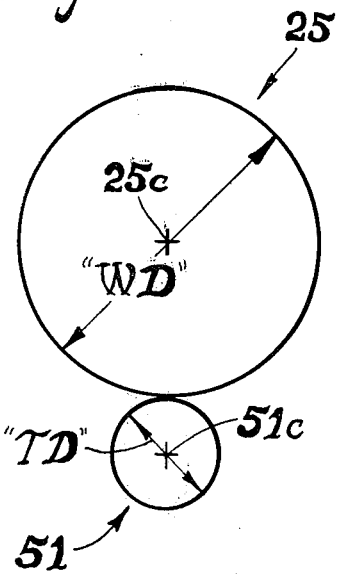
Figure 18:
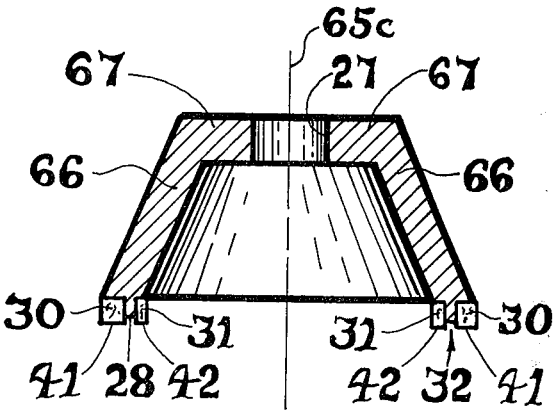
Figure 19:
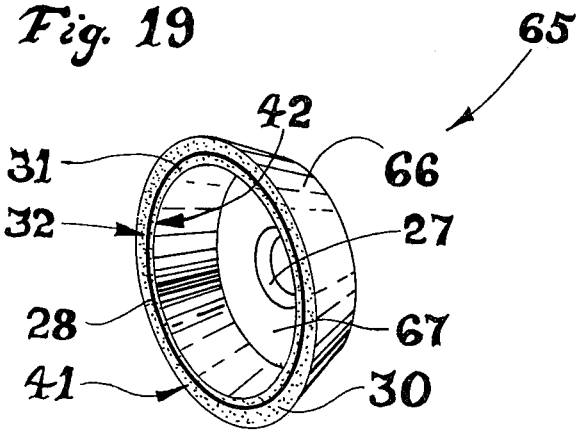
Figure 20:
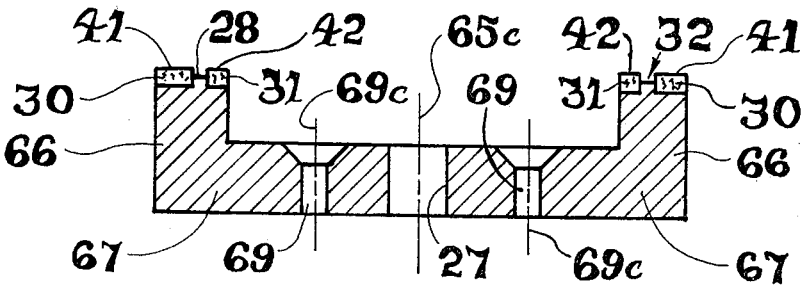
Figure 21:
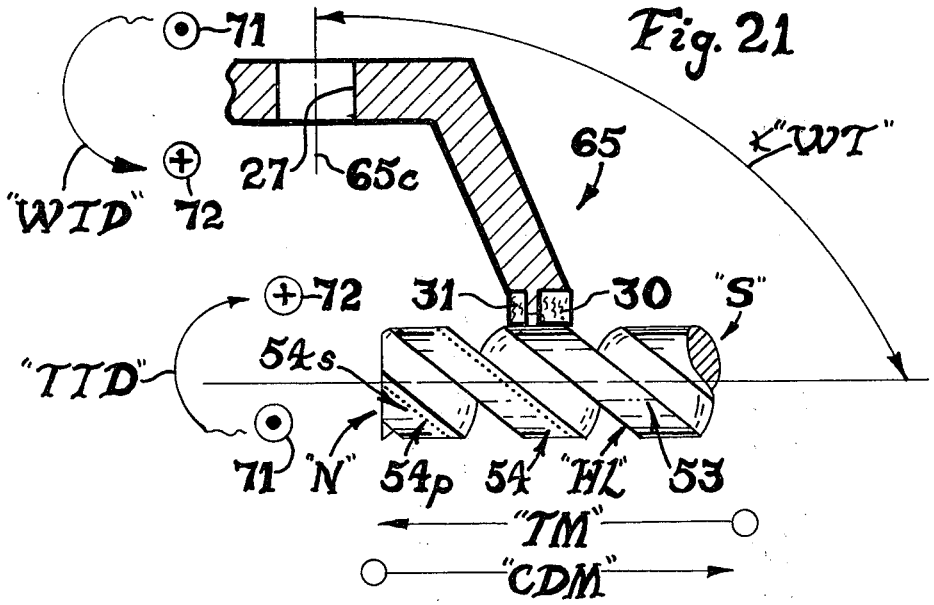
Figure 22:
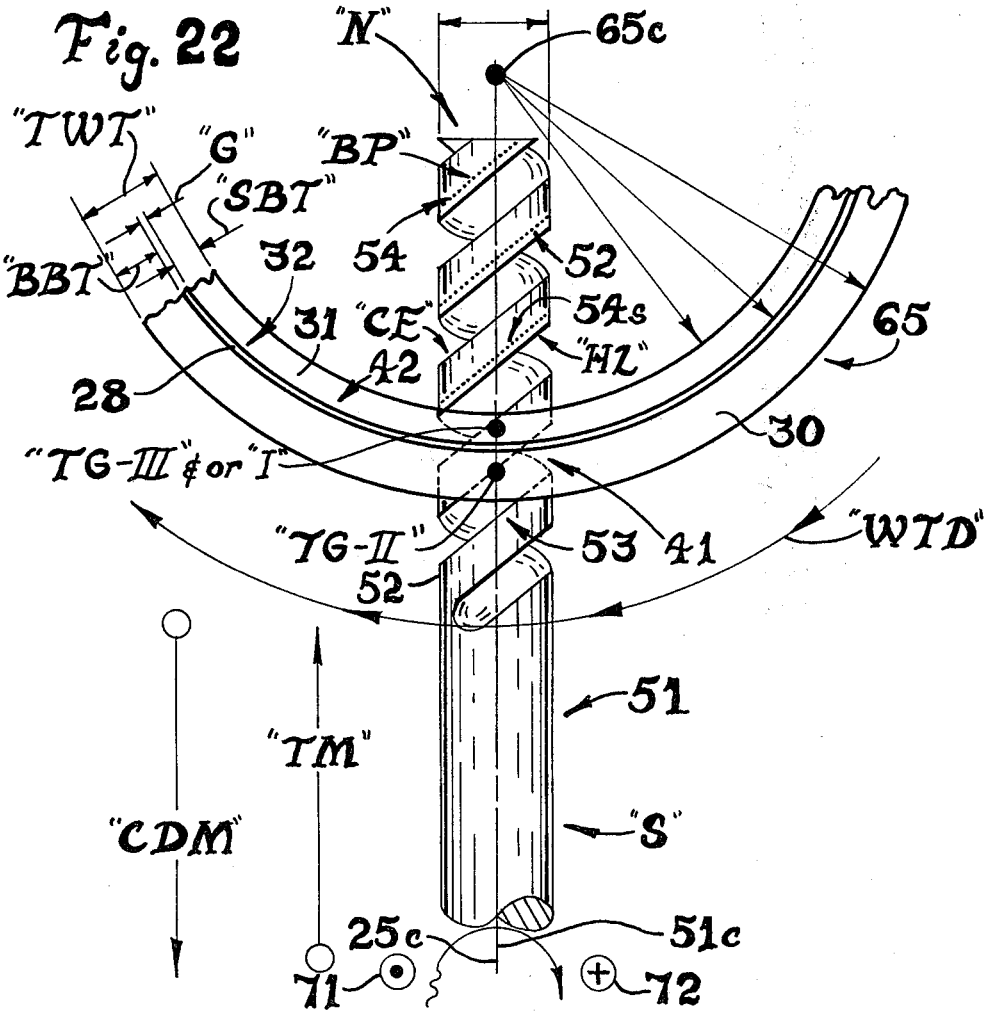
Figure 23:
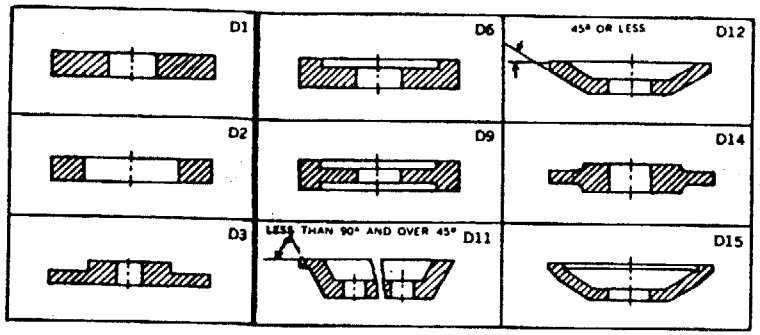
Figure 23:
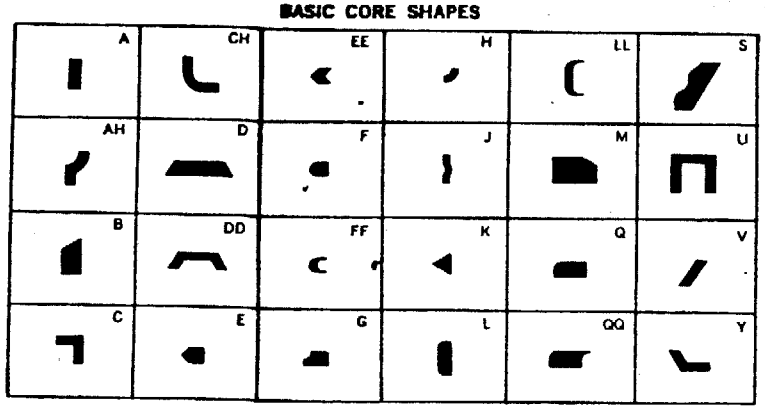
Figure 23:
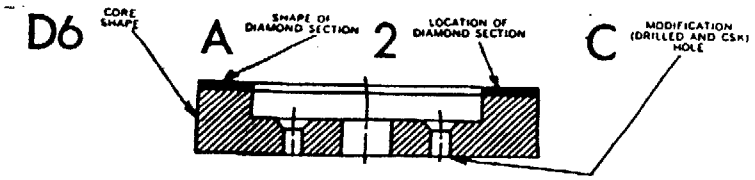
Figure 23:
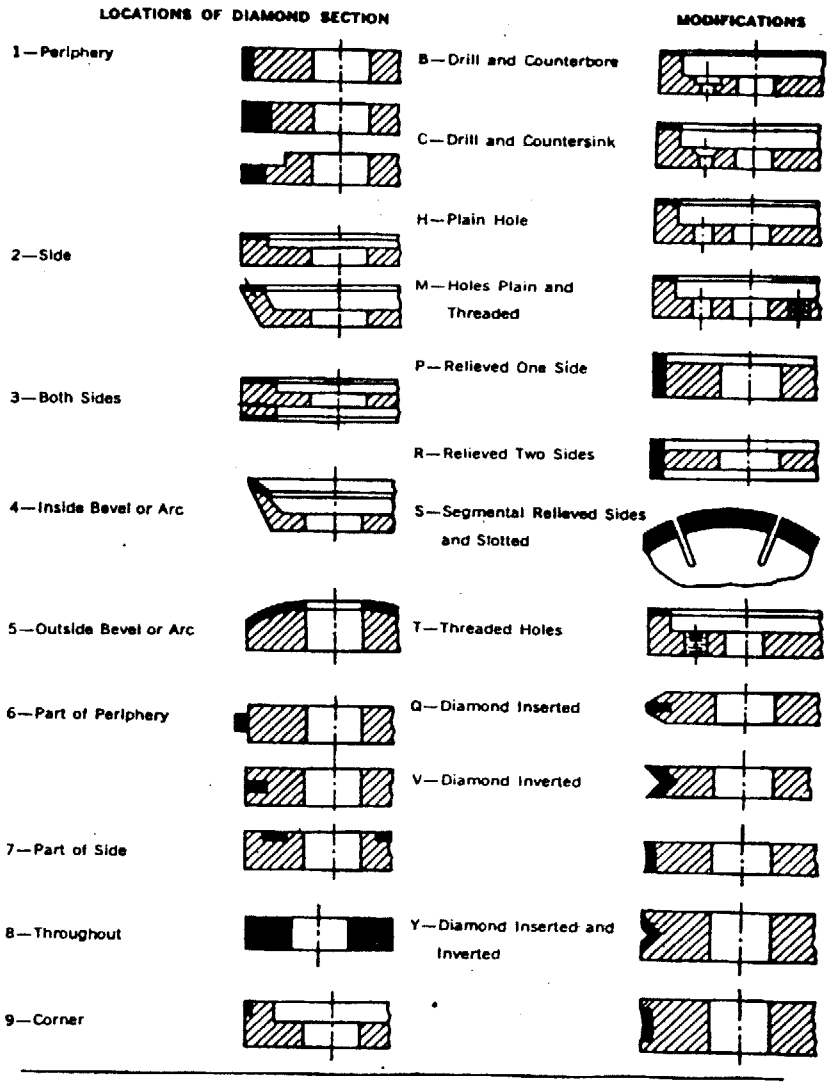

FIGS. 7–9, inclusive, are fanciful and highly exaggerated views of tooth profiles demonstrating patterns of material removal from the tooth flight periphery resulting from collated wheel and tool positioning during grind-sharpenings;

FIG. 10 is a view analogous to that of FIG. 6 but showing (in purposeful overextended misposition for sake of initial clarity) the disposition and employment of a simultaneously-effective, double-grinding wheel in accordance with the present invention to illustrate operation of the associated split and separately distinct abrasive working sections therein whereby its beneficial action is advantageously possiblilitated; with integrally associated FIG. 10A being a highly-amplified broken out view of the central portion of FIG. 10 to more faithfully and technically correctly replicate appropriate tangent placement positions of the respective grinding bands in operation on the part of the tooth flight periphery in actual process of being ground;

FIG. 11 is a fanciful view of a tooth profile illustrating the singly-performed, doubly-resulting sharpening action of wheels pursuant to the invention which give proper physical shape characteristics for effective cutting action capability of and in the tool being sharpened for use without need for multiple sequence processing procedures in the accomplishment;

FIG. 12 is a grossly exaggerated, side elevation view of a wheel in accordance with the invention showing the relative proportions involved in the split abrasive face assembly;

FIG. 13 is a fanciful broken away side elevation view of the wheel in accordance with the invention in cooperative, grinding contact with the tooth of a tool to be sharpened to particularly illustrate respective inter-adjustment of relative wheel and tool positions for securement of best desired results;

FIG. 14 is a view of a wheel in accordance with the present invention in combination with a tool being sharpened to illustrate frequently advantageous alterations in wheel adjustment on the flight periphery of the tool, the view being analogous to that of FIG. 4 insofar as concerns its mode of presentation;

FIGS. 15 and 16 are plan views fancifully representing different styles of helix tools which advantageously may be sharpened by single pass grinding using the simultaneous double-acting split abrasive wheel embodiments possible to have in keeping with practice of the present invention for helix tool sharpenings, the tool of FIG. 15 being specifically distinct from that of FIG. 16;

FIG. 17 is a schematic view to characterize advantageous relative respective wheel and tool diameters to employ in practice of the present invention;

FIGS. 18 and 19, respectively show a cup-variation of embodiment of a wheel in accordance with the present invention; FIG. 18 being an elevation in cross-section and FIG. 19 showing the cup wheel in fanciful perspective;

FIG. 20, in cross-sectional elevation, is a view of another form of straight-sided cup wheel in accordance with the invention;

FIG. 21 is a view made in a way analogous to that employed for FIGS. 6 and 10 to show utilization of a cup-form (schematically represented in broken-away fashion) of simultaneous double-acting split abrasive wheel embodiment in accordance with the present invention;

FIG. 22, drawn in a style analogous to that utilized for FIGS. 4 and 14 and in partly broken-away representation, is a view further illustrating placement and use of a cup-form wheel of the type depicted in FIG. 21; and FIG. 23 is a reproduction of diamond wheel shape designations devised by the AMERICAN STANDARDS ASSOCIATION in which pursuant to the appropriate AMERICAN STANDARD CODE there are employed a series of numbers and letters to define the wheel shape involving use, in four simple steps, of: (a) choice of basic core shape; (b) choice of diamond cross section shape; (c) selection of diamond section location; and (d) modification selection.

With an overview of the several depictions and views of the Drawing being maintained, the subsequent portion of this Specification now turns to a somewhat more detailed and particularized exposure of and elucidation upon the invention; including therein the most appropriate and expedient (or best) manners and means in which the same may advantageously and propitiously be embodied and practiced.

In this connection, the basic principles and limitations of conventional end mill and the like helical tool sharpening by abrasive wheel grindings and related techniques are so widely comprehended by those skilled in the art that detailed elaboration of all the basics thereof is not herein made or attempted; the same being unnecessary for thorough understanding and recognition of the advance contributed and made possible to achieve by and with the development of and in a simultaneously double-acting split abrasive wheel and the like for sharpening helix tools that is in keeping with the present invention.

PARTICULARIZED DESCRIPTION OF THE INVENTION

Figure 1:
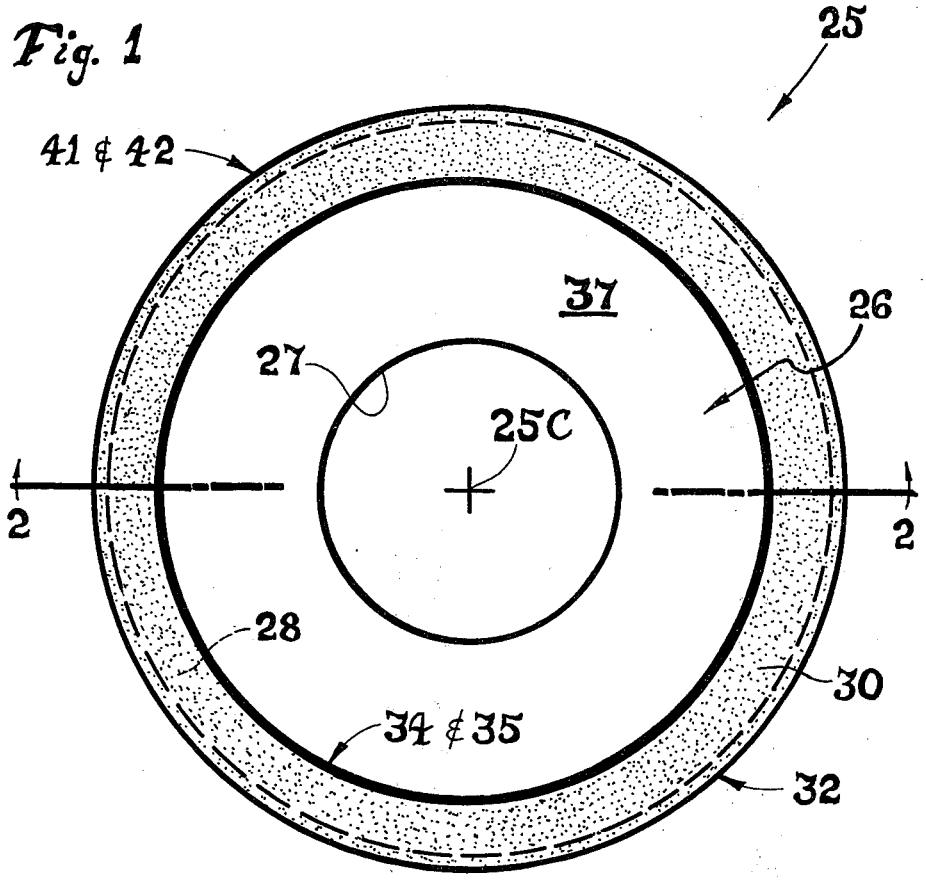
FIG. 1 is a plan view, partly in section, of a simultaneously double-acting split abrasive wheel for sharpening (or grinding) helix tools, such as end mills and the like, in accordance with the present invention.
Figure 2:
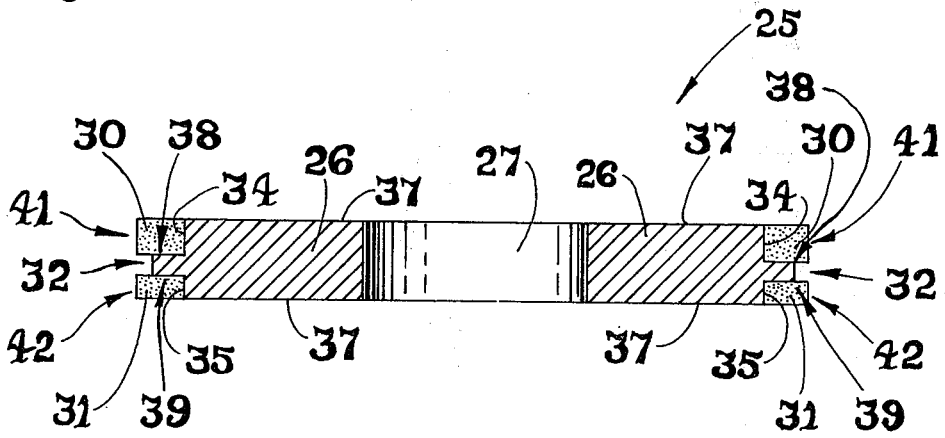
FIG. 2 is a cross-sectional elevation view of the wheel of FIG. 1 taken along the line 2—2 in FIG. 1.
Figure 3:
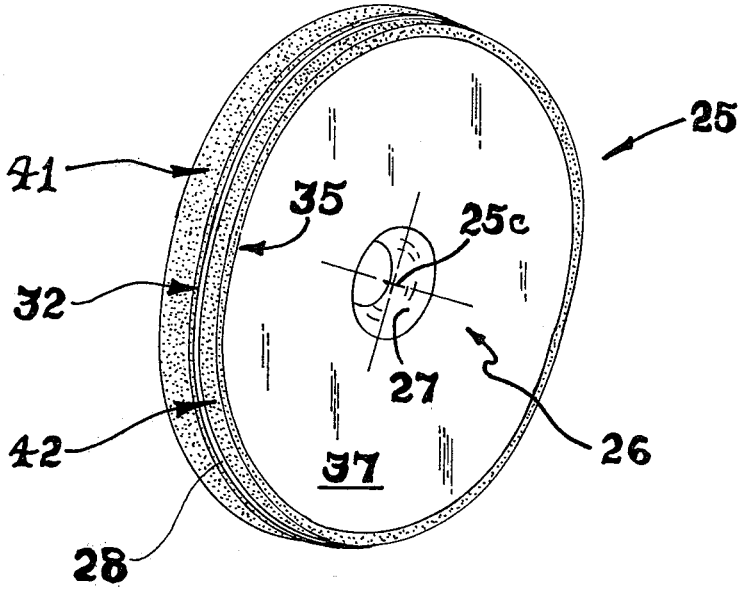
FIG. 3 is a view in perspective portrayal of the wheel shown in FIGS. 1 and 2.

With further reference now to the Drawing (in which, insofar as possible, like reference numerals and letters refer to and designate like parts, elements and interrelationships throughout the several views thereof), and particularly initially to FIGS. 1–3, inclusive, thereof, there is shown an assembled simultaneously double-acting, split abrasive grinding wheel in one suitable form of embodiment therefor in accordance with the present invention for finishing sharpening of helix tools, such as end mill cutters and the like; the same wheel being generally identified by reference numeral 25.

The disk-like wheel embodiment displayed in FIGS. 1–3 is constructed so as to be comprised of a circular central core 26 about the circumferential periphery of and on which there is provided (conveniently as an integral, projecting extension of the core) a relatively thin, outwardly-protruding ridge-like support rib or web flange 28. The core 26 has opposite side faces 37 and, for purposes of its mounting on a suitable support and rotating drive shaft (not shown), is provided with a central arbor hole 27. When mounted for operation on a drive shaft, wheel 25 is turnable in either direction as necessary or opted for a given grinding effect about its axis of rotation and perpendicular center line **25*c*** at any appropriate rate of revolutions per minute (i.e., "RPM").

Core 26 may be of any desired and adequate material of construction. It is usually of some metal, such as a mild steel or other ferrous alloy of suitable property characteristics. Aluminum and various aluminum alloys, however, is (are) very advantageous and often preferred for core fabrication; although in some cases tough and high-strength plastics, such as a nylon, polyester, polycarbonate or like polymeric product, may also be utilized. In general, the material of construction of core 26 must literally be softer than, so as to have no power to abrase, the material of the tool to be sharpened by wheel 25.

The major circumferential face of core 26, divided by the coaxial rib 28 standing thereover and extending outwardly therefrom, appears as the respective peripheral face and abrasive-bearing surfaces 34 and 35, the former being generally laterally wider than the latter. The vertical annular side faces of rib 28 (which lie in a plane at least roughly parallel to the plane of core side faces 37) are respectively identified by reference numerals 38 and 39. Upright side face 38 is disposed to overlook ated) for affixing and supporting the split abrasive bands of wheel 25 upon and between respective matching peripheral face and web side face pairs 34 and 38 and 35 and 39.

The hoop-like abrasive grinding bands 30 and 31, respectively, are provided and mounted secure in and by the said accomodating recesses therefor in the assembly construction of wheel 25. So spaced, the abrasive bands 30 and 31 have respective circumferentially flat peripheral grind surfaces 41 and 42 thereabout; these surfaces actually constituting the outermost round surface area in and on wheel assembly 25.

Abrasive band 30, generally wider, is physically separated and spaced away from the narrower abrasive band 31 by means of web flange 28. The inner diameter (i.e., "I.D." or "ID"), at core surfaces 34 and 35 level whereupon there is provided respective support for each of the abrasive bands 30 and 31, should very nearly if not exactly approximate the outer diameter (i.e., "O.D." or "OD") at said peripheral flats 34 and 35 of core 26 so that the bands fit very closely and snugly tight on the core and next to the web support and spacing rib 28, with at least the initial, as first fitted, equal OD of each band 30 and 31 at their respective outside grinding surfaces 41 and 42 greater than that of the OD of said web flange 28. There is thus formed and provided between the adjacent bands 30 and 31 an indented recess or gap 32 running circumferentially as a notched cut or groove splitting the bands on, about and around the outside surface of wheel 25; said gap lying in a plane that is generally parallel to the plane(s) in which each side face 27 of core 26 is disposed.

No particular critically attaches to the depth of gap 32, although it obviously should not be so deep as to interfere with effective and substantial side support and attaching area for the inwardly-disposed sides of the abrasive bands against the upright side faces 38 and 39 of web 28. In most cases when the same is reckoned in newly-fabricated and unused wheels, the differential distance determining this measurement between the OD of web flange 28 and the OD of abrasive bands 30 and 31 is so made that the gap depth is from, say, 10–25% of the thickness of the abrasive band(s). The split abrasive wheel assemblies of the present invention should not be employed beyond the point or extent of wear to surfaces 41 and 42 at which the OD of the abrasive bands 30, 31 is reduced, because of outer surface wear and erosion, to the OD of web flange 28. Just prior to reaching this point or as it is being approximately approached, good wheel maintenance observance dictates re-gapping of the distinct and separate abrasive bands to re-condition the wheel for further good use and avoid possible physical marring by the core material of the tool to be sharpened. Thus, when the band OD starts becoming the same as web OD, the latter should be turned down for wheel re-gapping to avoid deleterious influence on the tool being dressed as wearing diminution of abrasive band OD progresses.

In the context of relative material hardnesses involved, it is obvious that that of the abrasive band(s) must be greater, usually in considerable excess, than that of the tool to be sharpened. Usually, in illustration of this, the grinding ring bands 30 and 31 are each comprised of identical abrasive material which is generally in some chip, dust or other suitably finely-divided pulverulant or granulated form and bonded together in the applied shaped-ring style of abrasive belt, either coincidentally or separately, to and upon the wheel core 26 by suitable adhesive(s) or cementing material(s) or bonding agent(s), or by other adequate mechanical joining or fusing and installation means, as is well comprehended and practiced by those skilled in the art. Most frequently and preferably, diamond (natural or synthetic) in dust or chip form is fabricated into the adhesive rings by metal bonding for placement and incorporation in the wheel assembly 25. However, silicon carbide may also be employed for the purpose; as is also the case, for that matter, with other abrasive substances which in any event must, as is quite evident, be capable of necessary abrading action (usually by virtue of considerably greater hardness) for desired tool sharpening. For some applications, the bands 30 and 31 may be comprised of ceramic stock.

With further respect to abrasive band proportions, there is significant importance in the relative respective flat circumferential widths of the abrasive bands 30, 31 and the gap 34. This is illustrated in and by now going back to FIG. 12 of the accompanying Drawing. As is depicted in FIG. 12, wheel 25 has a total lateral circumferential width "TWT" which is the summation of the width "BBT" of the flat OD surface 41 of wider abrasive band 30 plus the lesser width "SBT" of the flat OD surface 42 of narrower abrasive band 31 plus the least width "G" of gap 32. In general, "BBT" should measure between about 60 and about 80% of the total of "BBT"+"SBT"; with "G" being a space corresponding to between about 5 and about 20% of "TWT". Advantageously: (i) the dimension of "BBT" is about three times (3X) that of "SBT" so that "SBT" comes to only about 25% of the total of "BBT"+"SBT"; In other words, the width dimension "BBT" is about at least one-and-one-half times (1½) that of "SBT" and usually no greater as to that of the former than about four times (4×) that of the latter. and (ii) "G" is about 10% of "TWT". Application of the more specific formula in a representative wheel assembly of the type shown in FIGS. 1–3 which is in accordance with the present invention wherein "TWT" is 0.250 inch (i.e., (") equalling 250 mils or 0.635 (cm) centimeter or 635 (mm) millimeters), the precise componental measurements are: "BBT"—0.135"; "SBT"—0.090" and "G"—0.025". More specifically typifying this, the "TWT" of most 1½" OD wheels runs from 0.0625" to 0.125".

The thickness taken from ID at surfaces 34, 35 to OD at surfaces 41, 42 of respective abrasive rings or bands 30, 31 is of no particular original or intermediately eroded and diminished criticality, excepting possibly as to how it plays a part in characterizing and defining the so-called "basic core shape" of abrasive band cross-section. Clearly, the abrasive bands cannot be at the outset (or worn to be from usage) so thin as to have no grinding capability for practical purposes or to be beyond the point of diminishing return insofar as concerns sharpening effectiveness. On the other hand, especially when costly diamond wheels are involved, excessive thickness of ring band structure may well tend to be: unnecessary; underlying of difficulty in satisfactory fabrication; and/or, for various reasons, unreasonably expensive for individual wheel purposes. Notwithstanding, conventional thickness-to-width (or reciprocal) ratios of originally installed split abrasive ring bands (including central gap width) employed may vary between values wherein the sum of "BBT"+"G"+"SBT" is as much as 5× and more to as little as 0.5–0.8× and less the involved thickness; the indicated ratio in the width-to-thickness aspect, of course, constantly increasing in favor of greater width to thickness proportions coincidental with and relative to erosive wearing away from use of band surfaces 41 and 42.

Another respective dimension parameter of ordinarily not overwhelmingly critical significance is that of "TWT" as compared to the lateral tooth measurement taken in profile at the periperal land of the tooth in the tool being sharpened. When smaller-sized tools are involved, "TWT" may be as great as 500× or more that of the tooth width; whereas, as larger tools are taken, "TWT" may be only 30— or so —× that of tooth width—with intermediate relative proportions appearing in intermediate tool size ranges. Somewhat related to this is the most appropriate wheel OD to utilize for given size tools to be treated. In this connection and also related to tool size, an appropriate "TWT" for the finest tools that are ground (viz., those having diameters on the order of 0.016" or even less) may be as little as 0.050" and usually not in excess of 0.100". Depending on and increasing with increases in tool diameter on a somewhat linearly proportional basis, "TWT" may be as great as 0.500" for sharpening tools of 8" and even larger diameters.

Likewise without exacting mathematically-related correlation about it, the optimum OD of wheel assemblies 25 pursuant to the invention tends, at least in step-wise increments, to increase with increasing size of tools to be sharpened. To illustrate, the OD of any given wheel assembly 25 (hereinafter referred to as "WD") for grinding tools having a diameter (hereinafter referred to as "TD") on the very fine side of, say, between 0.016" and 0.187" is ordinarily quite apt when it is of a 1½" size. Wheels with 3" "WD" are appropriate for tools with "TD's" in the range from about 0.218" to about 0.312". When the "TD" involved varies from 0.343" to 1.000", a 5" "WD" wheel is good; while most tools with "TD" in excess of 1.000" are well processed using wheels of 8" and possibly even larger "WD". As is apparent, there does exist for best and most satisfactory results an at least rough and usually step-wise relationship between increasing "TWT" optimums as above given and "WD" selections per the immediately foregoing notations for sharpening a tool of any given "TD".

Again referring back to a subsequent illustration in the Drawing, FIG. 17 schematically portrays relative ratios of "WD" to employ for any given wheel assembly 25 rotating about its central axis 25*c* in grinding any given tool, generally identified by reference numeral 51, being turned during the sharpening about its center line of rotation 51*c*. As can be seen from FIG. 17, "WD" is notably larger than "TD" in all cases. Thus, for nominal 1½"-size wheels, the ratio of "WD" to "TD" usually falls in the range of ca. 75–7.5:1. Wheels having 3" nominal size should generally be employed so that ratio "WD":"TD" is on the order of 150–30, or so:1; with nominal 5" wheels well adapted to utilization with such ratio on about a 14 or 10–5:1 proportion; and the relatively of the ratio best involved for 8" wheels being approximately "WD":"TD" figuring out at 5–2.5 or so:1.

Including at this interlude a cursory preview of FIGS. 18–20, inclusive, also subsequent in the heretoannexed Drawing and disregarding in many instances the integrally distinct and separated character of the split abrasive wheel constructions pursuant to and involved in practice of the present invention (as well, in individual given instances, the precise nature of the utilized abrasive), various and distinctive wheel embodiment conformations possible to herunder provide and employ may be at least approximately—and without limitation or restriction thereto or thereabout—conveniently designated and indicated in and according to the well-known standard "Identification Code For Diamond Wheel Shapes" prescribed and assigned by the AMERICAN STANDARDS ASSOCIATION (a reproduction of same being set forth in FIG. 23 of the drawing) including:

(a). For disk-configured wheels:
- (1) D1A3H; or (and arbitrarily taking "A" to be a double, adjacently disposed, split and separated, both-sided mounting considered to be identifiable for present purposes as "A+A'") such as
- (2) D1A+A'1H (and so forth);
- (3) D2A3H
- (4) D6A3H;
- (5) D9A3H; and then
- (6) D2A+A'1H;
- (7) D6A+A'1H;
- (8) D9A+A'1H; or
- (9) D1A+A'6H;
- (10) D2A+A'6H;
- (11) D6A+A'6H; and
- (12) D9A+A'6H; plus
- (13) D1A+A'9H;
- (14) D1A+A'9H
- (15) D6A+A'9H; and
- (16) D9A+A'9H; while (b). For cup-configured wheels:
- (17) D15A3H;
- (18) D12A3H;
- (19) D11A3H; and
- (20) D6A3H or (and again using the same arbitrarily-added designation of "A+A'" for "A" as above);
- (21) D15A+A'1H;
- (22) D12A+A'1H;
- (23) D11A+A'1H;
- (24) D6A+A'1H; or
- (25) D15A+A'6H;
- (26) D12A+A'6H;
- (27) D11A+A'6H; and
- (28) D6A+A'6H; plus
- (29) D15A+A'9H;
- (30) D12A+A'9H;
- (31) D11A+A'9H; and
- (32) D6A+A'9H.

From consideration of the Code in FIG. 23 and taking various mounting possibilities into account, it is evident that in all cases the last above-given "H" identification for style purposes can readily, if desired, be replaced with —B—; —C—; —M—; —T—; and even conceivably —P— or —R— type constructions for wheel mounting purposes.

Along this line and as will also be evident from study of the Code, even other particularized wheel embodiments in either disk-like or cup-like configurations can be assembled in accordance with the present invention—even though they would involve possibly larger side-exposed abrasive band surfaces not actually utilized for tool contact in the presently contemplated sharpening operations. Thus, if double, parallel core-encircling web flanges were employed in appropriately spaced relationship, the abrasive bands involved could well be a split pair of rings having U-shaped diamond (or other abrasive) cross-sections so as to be designatable (following the above-employed deviated scheme) as, in effect, a D6U+U'3H pattern for disks or a D15U+U'3h pattern for cups, and so forth to cover all possible forms in such semblance. Analogously, C-shaped abrasive cross-sections could also be utilized in both-sided corner mounting locations so as to provide configurations describable per the Code (with resort to the foregoing deviated designation scheme), as, for example, a D2C+C'9H disk or a D15C+C'9H cup, etc., etc. in corresponding extension of all above drawn out and indicated.

In the interest of replete comprehension and appreciation of implementations and practice in accordance with the present invention, it is appropos to indulge in outset review and consideration of the ordinarily conventional and heretofore known appliances and operations commonly employed for sharpening helix tools. This is now embarked with conjunctive reference to FIGS. 4–9, inclusive, of the Drawing which largely illustrate the old-fashioned means and techniques therein involved.

For this (and with pertinent applicability to the novel embodiments and advantageously simplified advanced techniques pursuant to the instant invention), it is rudimentary to take full cognizance of what is intended and attempted to be done and effected in any sharpening of axially rotatable helix tools whose functional peripherally-surfaced cutting edge(s) (i.e., "CE") have a radially outward effective action and thrust thereabout. This is better perceivable with particular attendant attention to FIG. 5 which schematically provides the cross-sectional profile and essential basic geometry of a representative tooth "T" in and from any given spiroid flight of a helix tool (generally identified by reference numeral 51), the specifications for the bulk of which are charted in the following TABLE to be associated with FIG. 5 in contemplation thereof.

TABLE

Figure 5:
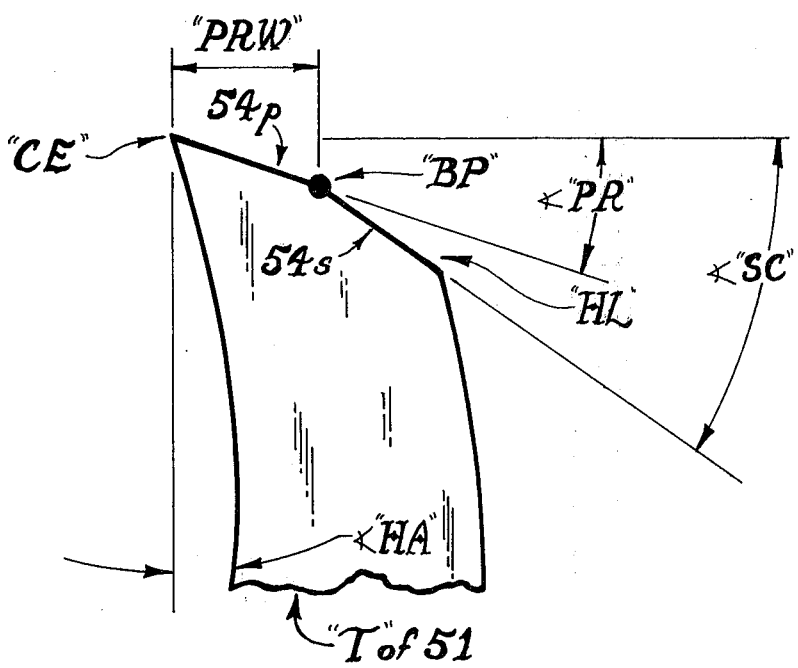
FIG. 5 is a schematically-represented view showing the general profile of a tooth, illustrating the later-explained major characteristics, in a typical helix tool having about its central root the spirally-disposed and -proceeding working and cutting element flights as in end mills and like appliances.

Chart Of Spiral End Mill Cutter Relief Specifications (For General Work Purposes) - Relevant Measurements Listed Pertinent To Tooth Particulars Identified And Illustrated In FIG. 5 Of the Drawing*

| Cutter Size (In Inch(es) (i.e. ") Of Diameter)+ Starts As Small As @ 0.016 | Primary Relief In ° Of ∟"PR" Min. | Primary Relief In ° Of ∟"PR" Max. | Secondary Clearance In ° Of ∟"SC" (Constant) | Primary Relief Land Width (Inches) Min.+ | Primary Relief Land Width (Inches) Max.+ |
|---|---|---|---|---|---|
| 0.062 | 22 | 27 | 30 | 0.002 | 0.010 |
| .093 | 18 | 23 | 25 | .002 | .010 |
| .125 | 16 | 20 | 25 | .002 | .010 |
| .156 | 15 | 19 | 25 | .003 | .015 |
| .187 | 14 | 17 | 24 | .004 | .015 |
| .218 | 13 | 15 | 24 | .004 | .020 |
| .250 | 12 | 15 | 23 | .005 | .020 |
| .281 | 12 | 15 | 22 | .005 | .020 |
| .312 | 12 | 15 | 22 | .006 | .025 |
| .343 | 11 | 14 | 19 | .006 | .025 |
| .375 | 11 | 14 | 19 | .007 | .025 |
| .406 | 11 | 14 | 19 | .008 | .025 |
| .437 | 11 | 14 | 19 | .008 | .030 |
| .468 | 10 | 14 | 18 | .008 | .030 |
| .500 | 10 | 14 | 18 | .010 | .030 |
| .562 | 10 | 13 | 18 | .010 | .030 |
| .625 | 10 | 12 | 18 | .012 | .035 |
| .687 | 9 | 12 | 18 | .012 | .035 |
| .750 | 9 | 11 | 17 | .015 | .040 |
| .812 | 9 | 11 | 17 | .015 | .040 |
| .875 | 9 | 11 | 17 | .015 | .040 |
| .937 | 8 | 11 | 16 | .015 | .050 |
| 1.000 | 8 | 10 | 16 | .018 | .050 |
| 1.125 | 8 | 10 | 14 | .018 | .050 |
| 1.250 | 7 | 10 | 14 | .020 | .060 |
| 1.375 | 7 | 10 | 13 | .020 | .060 |
| 1.500 | 7 | 10 | 13 | .020 | .060 |
| 1.625 | 7 | 9 | 13 | .020 | .060 |
| 1.750 | 6 | 9 | 12 | .020 | .060 |
| 1.875 | 6 | 9 | 12 | .020 | .060 |
| 2.000 | 6 | 9 | 12 | .020 | .060 |
| 2.250 | 5 | 8 | 12 | .025 | .060 |
| 2.500 | 4 | 7 | 12 | .025 | .060 |
| 2.750 | 4 | 7 | 12 | .030 | .060 |
| 3.000 | 4 | 7 | 12 | .030 | .060 |
| Goes To As Large As 6-8+" | | | | | |

NOTES:
(i). Typical Hook Angle (i.e., "HA") On Order Of 5°-9°;
(ii). Setover Figures For Fluting Radial Rake (Usually @ 5°, 10°, 12°, and 15°), Reckoned By Equation "SET OVER (SO) = Radius × Sine of Rake Angle. Not Included; and
(iii). End Teeth (Primary On 2 Flute) 5° 8°.
+0.001" (or 1 mil) = 2.54 mm = 0.00254 centimeter In order to fully dress a helix tool 51 in the most proper and desirable manner, there is perforce therein provided from the pre-formed blank or stock supply being sharpened both a primary relief ("PR") having an exposed tapered land surface **54*p* which ititiates at the "CE" and proceeds back therefrom at or through the plane of a characterized and at least mean angle (i.e., ∟"PR") which is in a general incline directed from without the tool radially downwardly to the root and/or axial center line 51*c* of the tool 51; ∟"PR" being thus sloped and measurable taking center line 51*c* as its horizontal base or, alternatively, using for such reckoning the peripheral tangent line of the tool parallel to center line 51*c*. The "PR" is then, going back and away from the "CE" to the heel portion (i.e., "HL") of the tooth "T", most advantageously followed by a secondary clearance ("SC") progressing towards and into and clearing out of the heel ("HL") of tooth "T" and having an exposed increased-taper land surface 54*s* (which is separately constituted and distinct from land 54*p* with a greater slope thereabout than is in "PR"). Land 54*p* proceeds through the general plane incline of a characteristic and at least mean angle (i.e., ∟"SC") also measurable with reference to center line 51*c*. The width ("PRW") of angularly directed land surface 51*p* is generally measured horizontally between a boundary extending from "CE" towards "HL" within vertical mete lines that extend in a direction normal to center line 51*c* of the tool 51. At the juncture of land surfaces 54*p* of the "PR" and 54*s* of the "SC" intermediate of the entire peripheral face of the dressed tool is the break point "BP"; this being the point of divergent change in angulation of said respective adjoining peripheral land surfaces 54*p* and 54*s*** at which ∟ "PR" stops insofar as concerns its physical discernability and ∟ "SC" commences.

The hook angle (∟"HA") generally defines the pitch of the tooth flight as it bends or leans in the "CE" direction; the same for achievement of instantly contemplated ends being of no great import or consequence excepting to take into account that some, and usually a pronounced, ∟ "HA" is preferential in good tool design to ensure most efficient and effective "CE" performance.

As has previously been alluded to and as is clearly evident from the specifications charted in the TABLE, values of "PRW", ∟"PR" and ∟ "SC" are of considerable import for getting best performance from any given (size) helix tool. These not only imbue superior sharpness and shaving performance capability in the "CE", but function to provide physically well supported and rigidly strong "CE" and "T" body contours in the tool tooth structure that are well adapted to maximized heat dissipatability and good chip clearance during the milling and cutting usage of the tool. In this, superior results are generally facilitated for readily apparent tool design by keeping, at and for any given size of tool, relief angles (especially for "SC") as minimized as possible; the same ordinarily being small minor angles of not more than about 30° or so at the utmost with the change in angulation at the "BP" between ∟"PR" and ∟"SC" being in a typically encountered range of from, say, 4° or so minimum to 7°-8° or so maximum.

Looking more closely now at FIGS. 4 and 6 of the Drawing, there is therein shown a conventional sharpening operation on an end mill tool 51 using a normal, standardly-employed, unitary and solidly constructed, single-band grinding wheel which is generally identified by reference character **25*n*. Wheel 25*n* has a solid-faced abrasive grinding periphery designated generally by reference numeral 40. The wheel 25***n* turns about its center line 25*c* and, as shown, is being rotated and twisted in a (counter-clockwise) direction "WTD" as indicated by the movement symbols 71 and 72; the encircled dot (.) of the latter legend 71 symbolizing movement up and out of the plane of, and contrary to the sighting direction involved in, the taken view while, to depict oppositely-directed relative motion into the plane of the view going in and with the involved line of sight direction, there is employed the encircled cross (+) symbol numbered 72.

Conventional grinding wheel 25*n*, with both its wheel radius "WR" and wheel diameter "WD" spaced out, rests in an abrading relationship on the unground peripheral face land surface 53 of the portion of the tool flight 52 being (or intended to be) sharpened by the wheel. The geometrically centralized point of contact is designated by the tangent point dot or darkened circle "TG". The distance between wheel center line 25*c* and tool center line 51*c* is indicated by the reference letter "WT". Actually, in order for grinding to be accomplished and to facilitate the necessary bight-taking or edge-removal action by the wheel working into and actually depressing under the original peripheral land surface 53 of the tool being sharpened, distance "WT" must be somewhat—usually only slightly—less than the total(s) of distances "WR" plus ½"TD". The relative and more than closely-nipped positioning of wheel 25*n* and tool 51 are thus made and set so as to properly accomodate such requisite relationship; the precise depth in-going or inset of the wheel on the tool periphery being of course somewhat dictated by the "PR" and/or (subsequently in conventional operations) "SC" cuts to be taken. In any event and frequently somewhat as a result of this, the actual cutting diameter of most end mills is usually less than the shank diameter.

The tool 51 being ground for sharpening is shown as a conventional end mill. It has a front or nose portion "N" and an opposite shank or rear portion "S". The tool flights 52 (there usually being a plurality of at least four of same on a typical given tool) generally proceed at some pre-determined flight pitch-to-shank angle (∟ "FSA") while emanating from some part of the shank portion "S" towards and with termination at the nose "N". The angular value of ∟ "FSA" is selected to best fit intended end-use purposes for the tool, with something on the order of 10°–30° or so being common (although more to as much as 60°–80° or less to an almost straight-flighted tooth and flute pattern is possible and known for given tool designs).

Although end mills are very popular and useful forms of helix tools to be sharpened either by conventional techniques or by practice of the present invention, other varieties may also be involved. These include, for example, reamers of the straight (having either solid or inserted type blades), shell types or so-called "chuck" varieties. Additionally, it is not impossible to dress even certain types of spiral broaches if the overall grinding machinery assembly utilized is made so as to have or permit an elevating adjustment between the wheel and the tool passing thereunder to accomodate the taper in the tool as the wheel is progressively passing therealong towards one end or the other in the course of the sharpening operation.

Along this line, helix tools are generally further characterizable by the direction of flight spiral thereon (as when viewed from the shank "S" looking to the nose "N") and the appearance from the same vantage point of the cutting edge ("CE") and heel ("HL") provided on the tool (viz., which portion of the tooth profile lies in, say, the shank direction). Thus, if the spirals are twisting to the right, the tool is defined as having or being composed of a "Right Hand Helix" (i.e., "R.H.Hlx.") and oppositely if the spirals convolute to the left so that the tool has a "Left Hand Helix" (i.e., "L.H.Hlx."). At the same time, if the "CE" aims either towards or away from the nose "N" of the tool while pointed so as to be inclined or edge slanted towards left of center line 51*c*, the tool is known as having (or being one with) a "Left Hand Cutting Edge" (i.e., "L.H.CE"); with there being a "Right Hand Cutting Edge" (i.e., "R.H.CE") with the obverse "CE" situation and alignment. The precise combination in any given tool of "CE" disposition towards nose or shank and helix pattern to right or left with the direction of tool rotation (i.e., "clockwise" or "counter-clockwise" as reckoned from the shank end) determines the chip direction movement (i.e., "CDM") in operation of the tool; this merely indicating whether chips cut by the tool and coming from a work piece are moved for clearance through the flutes and along the tool length towards the nose "N" or, conversely, rearward towards the shank "S". Even though likely apparent, it should be pointed out that ∟ "HA" slants oppositely to that shown in FIG. 5 when the "CE" of the tool involved is directed towards the shank.

Merely for illustrative purposes, the end mill tool 51 in FIGS. 4 and 6 is of a "R.H.Hlx./L.H.CE" style. And, also merely for further illustrative purposes of showing the involved contrasts in the immediate context hereof: the tool 51 in FIG. 10 is "R.H.Hlx./R.H.CE"; that in FIG. 14 is "L.H.Hlx./R.H.CE"; tool 51 in FIG. 15 is "R.H.Hlx./L.H.CE"; that in FIG. 16 is "L.H.Hlx./R.H.CE"; while that in FIGS. 21 and 22 is a "R.H.Hlx./R.H.CE" end mill. Disposing of the "CE" portions towards the shaft of the tool in FIG. 16 would render it to a "L.H.Hlx./L.H.CE" arrangement (with the "CDM" then going from nose to shaft). Despite the several explained variations possible to have, most commonly-encountered end mills seem to be "R.H.Hlx./R.H.CE" design.

In any event, the tool 51 in FIGS. 4 and 6 is illustrated as having a "clockwise" tool twisting direction "TTD" which goes against the "counter-clockwise" movement "WTD" of wheel 25*n*. The tool, conventionally, is twist fed against the wheel at a very slow rate of turning; this actually being merely that adequate to feed it into and against the wheel to the stroke-ending stopping-point upon finish of the grinding passage. The relative directional motions about ther axis of rotation of the wheel and tool can obviously be reversed. Or, for that matter, both "WTD" and "TTD" can be made to proceed in the same rotary direction, even though this is a generally less preferable way to operate especially to secure usually better and more efficient grinding (obtained, as it were, across the "grain" of the tool tooth) by the wheel so that it moves into and contra the sharp edge of the "CE" being fashioned.

In a usual (although optional) sharpening operation, the rotating grinding wheel is kept in a fixed position with the slowly twist-fed tool being treated so processed that it is passed nose first into and through grinding contact with the wheel (usually, although not necessarily, in an underneath position) in the indicated direction "TM" of forward linear tool movement along the path of its center line 51*c*. Alternatively (although not demonstrated in the Drawing) and especially with cup-form wheels and hereinafter mentioned air spindles, the tool may be first dropped to clear under the wheel past the flutes; then positioned against the wheel and pulled back for sharpening rearwardly (in the opposite nose-to-shank "TM" direction contrary to that designated in the Drawing) with tool movement proceeding backward towards the shank as the tool is so passed in reverse-moving grinding contact with the wheel. The forward progress (or backward progress, as the case opted to use may be) or thrust of the slowly turning tool against and past the wheel can ge accomplished in any of several suitable known ways (none of which are shown or illustrated in the Drawing). For example, the tool can be mounted on a positively-driven, forward or backward moving rotating cam gear designed with an identical helix pattern arrangement to correspond with the tool teeth flight procedure so as to be capable of accurately drawing the tool either way under the wheel for grinding. More often, however, the tool is mounted in some form of chuck or the like holder (not shown) and impelled in either a pulling or pushing manner by pneumatic or other fluid drive means such as an air spindle (also not shown but popular for use with cup wheels), with proper rotation and thrust control for linear movement progress being implemented and effected in the well-known way by a "finger" guide or attachment (shown in phantom outline and designated by reference numeral 101 in FIG. 4) positioned for the purpose in a flute portion of the tool 51.

While variable with particular apparatus installations and involved grinding requirements, the gradually-fed tool being dressed is ground with wheels, depending on size, that may be rotated at rates between about 3,500 RPM and about 20,000 (and even more) RPM. Larger wheels are generally more slowly rotated for the sharpening; the reason for this being due to the then greater speed rates of peripheral movement and advance at any given RPM driving. Thus, a 5" OD wheel may be ordinarily satisfactorily run at 7,000 RPM (down to as slowly as, say, the 3,500 RPM level); while 1½" wheels—a popular size for cup-form embodiments—can be made to turn from 10,000 RPM to as much as 15,000–20,000 RPM. Notwithstanding actual implementations involved, the wheel should be driven with enough (appropriate) speed and power at functionally-effective settings to ensure avoidance of roughness, scarring or marring and getting very nice and smoothly-polished finishes in the dressing.

FIGS. 6–9, inclusive, more particularly demonstrate and teach how the conventional old way to sharpen helix tools is done, albeit requiring a two-step procedure. In this, it must be borne in mind that the tool 51 being sharpened is twisted peripherally upwardly into the rotating grinding wheel in such a way that it moves towards and with grinding contact past the wheel with the tooth flight 52 more or less parallel with wheel center line 25*c* (the relative parallelism depending, of course, on involved ⌊— "FSA") giving an essentially lateral, "across-the-tooth-periphery"or "side-to-side" passing contact of turning tooth flight lands with respect to the rotating wheel. This, when a disk-like wheel is employed as shown in FIGS. 4 and 6, gives an actually concave (although essentially flat for practical purposes) cut on and into the peripheral unground land surface 53 of the tooth "T" being dressed; this due to involved grinding wheel curvature. Increasing the ratio of "WD" to "TD" (and the independent yet associated width of the peripheral land) brings about in the cut taken a condition more perfectly approaching flatness with more straight delineations, as it were, in the resulting ⌊—'s "PR" and "SC".

It accordingly becomes apparent that the "TG" positioning of the wheel on the peripheral land of the tooth flight is of great and basically controlling importance to the nature, depth and relative positioning location of the relief cuts made in any given grinding use of a conventional wheel 25*n* for helix tool sharpening purposes. Thus, when the tangent point of the wheel is so adjusted as to come to rest (at least initially on unground surface 53) and be, after grinding commences, in depressed location for practical purposes about centrally with respect to the peripheral land surface of the tool flight, as is illustrated by the (heavy dot or blackened circle) tangent point positioning designated "TG-I" in FIG. 6 of the Drawing, the cut taken usually goes pretty much across the peripheral land 51*p* of the tooth "T" from the "CE" and ordinarily down and somewhat less elevated in the "HL" as FIG. 7 depicts in exaggerated fashion with the involved cut in dashed outline identified as Cut "A". This may afford primary relief as the first step of the conventional operation. However, the best cutting edges and most appropriate ⌊— "PR's" are not always and invariably obtained when a central tangent point "TG-I" is utilized for attempting to get the primary relief cut.

Thus, in order to ensure getting of more satisfactory "PRW" and ⌊— "PR", it is customary to take the first cut for "PR" with the wheel tangent point set more towards the intended "CE" side of tooth flight land periphery (unground) 53, as illustrated by point "TG-II" in FIG. 6 which makes Cut "B" as drawn out in FIG. 8.

Now then, by the conventional technique, only either Cut "A" or Cut "B" (or something like them) can be made in the first step of the operation. This may provide some desired "PR", but unless an inferior sharpened helix tool product can be tolerated (wherein no "SC" is imparted to the profile of tooth "T"), it has generally been necessary to do a second stage or separate subsequent step operation in order to impart the beneficial and generally much preferred "SC" features in and for the desired dressed tool. Sometimes this has been done by additional manual grinding procedures. Alternatively, however, the getting of the important "SC" and ⌊— "SC" characteristic(s) has been accomplished by re-passing the tool through the wheel with readjustment of the tangent point towards the "HL" side of the tooth profile. This is illustrated by tangent point setting "TG-III" (as shown in FIG. 6) to give the Cut "C" for the "SC" depicted in FIG. 9.

Although it is intended to be taken and considered primarily in connection with practice of the present invention, FIG. 11 of the Drawing brings out the effect of the double cut on and in the tooth profile so that the finished article has both the desired "PR" exhibiting its tapered land surface 54*p* and "SC" with its more greatly angulated and broken tapered land surface 54*s*; the former resulting from Cut "A" (drawn with a dashed line) with the latter being brought about by the taking of either Cut "B" or Cut "C", or both (shown by dotted line drawing); the encircled break point "BP" therebetween also being illustrated in FIG. 11. In this connection, incidentally, it is significant to note and take account of the fact that the metal removed from the unground tooth periphery 53 to achieve "PR" Cut "A" is considerably greater and more voluminous than that involved for subsequently making "SC" Cut "C" (and-/or Cut "B", as the case may be).

The setting of various tangent points "TG-I", "TG-II" and/or "TG-III" (or desired or necessary intermediately graded deviations therefrom) is generally done by moving the relative central contact point of the wheel with respect to the more or less laterally located tangential contact across and/or in the tool tooth periphery on the moving flights intended to be ground. This is normally accomplished by longitudinal relative back and forth movement along the tool and wheel center lines of either the wheel or, more commonly, the disposition of the tool with respect to its relative peripheral flight contact point with the wheel. The means for making such adjustments, especially by tool movement, are well known and commonly resorted to, hence they are not herewith particularly illustrated. Usually, the table mounting (not shown) for holding and handling the wheel is slid or otherwise re-positioned back and forth along the wheel center line 25*c* to make the desired adjustment. This, although the showing is also primarily intended to be taken and considered in connection with practice of the present invention, is schematically illustrated in FIG. 13 of the Drawing. As therein brought forth, the straight-shafted arrows 60 illustrate the relatively forward (and in respect of the tooth periphery thereon and therewith) disposition of the grinding wheel with backward and towards the shank movement of the support table or other tool holding means (not shown); while the obverse is true with forward movement of the tool holding means as represented by the wavy-shanked arrows 61. Of course, the same net result is accomplished if forward or backward (with respect to tool nose direction) of the wheel is alternatively made for the adjusting purpose accomplishment.

The foregoing elucidation lis germane to and facilitative of good comprehension and full appreciation of the many unexpectable benefits and advantages of practice in accordance with the present invention. The essential and "beauty-part" feature of this, which lies in the capability made possible thereby of grinding helix tools to excellently sharpen and dress them in a one-step, simultaneously executed machining procedure wherein and whereby proper "PR's", "PRW's", ⌊-'s "PR", "SC's" and ⌊_'s "SC" are all at once imparted to the "CE"-containing teeth flights of the tool being operated upon, is especially illustrated in and by the showings of FIGS. 10 and 14 of the Drawing. Entire grasping of these views also entails emphasized recollection of the previously-discussed and -explained showings of FIGS. 1–3, 5 and 11–13, inclusive.

As portrayed in conjugated FIGS. 10 and 14, a double-banded, split abrasive grinding wheel is in action for sharpening in a single operational pass an end mill helix tool. Even though (as has been pointed out) the end mill depicted in FIG. 10 is "R.H.Hix./R.H.CE" while that in FIG. 14 is "L.H.Hlx.R.H.CE", the basic principle involved is closely related and essentially the same insofar as concerns applied theoritics.

For facilitation of the bulk of initial procedural explanation, it will be assumed that the tool 51 is being made to forwardly proceed into wheel 25 so as to first pass into and make grinding contact with the wider peripheral abrasive surface band 41 of the split wheel and then, in sequence immediately following after that, with the narrower band 42. The (with such procedure) "PR"-effecting tangent point "TG-II" (and/or "TG-I") on the wider band band 41 is set towards the "CE" side of peripheral land 53 of the tool flight 52 so as to take and make the "PR" Cut "A" (and/or "B") at the appropriate "PR". Simultaneously, the "SC"-effecting tangent point "TG-III" (and/or "TG-II") is set towards the heel ("HL") side of the flight periphery so as to take and make the "SC" Cut "B" (and/or "C") at the appropriate "SC" with the "BP" calculated to be made to occur on the ground periphery of each tool flight 52 to result in the proper "PRW" dimension with respect to relieved peripheral surface 54*p* before start of the further relieved and more sharply broken peripheral surface 54*s*. If, obversely, a rearward-passage is made (as is possible and practiced), the larger amount of cutting by wide band 41 goes to "SC" with the final "PR" cut taken by the narrower band 42. In either way, the tool is thus simply and without undue complications and repetitive sequences well dressed and done in a single manipulative operation without re-passage requirements or subsequent finishing steps needed.

Of course, for given tools being sharpened, the split abrasive wheels 25 in accordance with the present invention need apt and coordinated sizing with respect to their "BBT", "SBT" and "TWT" dimensions relative to peripheral flight width of the tool and desired final measurements and characteristics to be made (following again the showing of FIG. 5 and the preceding TABLE chartings associated therewith). To achieve this in practice of the invention with given matching and correlative wheel and tool sizes simply, as is and will be readily recognizable by those skilled in the art, requires adroit wheel setting on the tool as is self-evident in the showing of FIG. 13 considered in the light of the immediately foregoing description.

In any event, the operating action of the split abrasive wheel 25 pursuant to the invention is surprisingly simple and dramatically effective. As the twisting tool moves into the wheel, it first engages the wider band 41 for the "PR" grinding; then, continuing to move in the upwardly-twisting helix path of rotation, secondarily engages the narrower wheel band 42 for the "SC" grinding. The actual grinding of the "HL" portion of the tooth flight is done to the major involved extent after clearance by the tooth of the non-grinding gap portion 32 interior of the overall split wheel surface with the tooth flight then coming up and under the wheel following and at the fixed spaced-distance thereof from the "CE". As indicated, rearward tool passages cause greater "SC" cutting by the wider band instead of doing it on "PR".

In this sequence arises and resides the importance of the greater dimensional thickness (or flat peripheral band width) "BBT" of the wider abrasive segment 41 in comparison to the thinner "SBT" of narrower band 42. As has been noted in connection with the discussion of FIGS. 4 and 6 dealing with the heretofore-known conventional sharpening, the "PR" cut is greater and involves more metal excavation (unless, as is unlikely but in any event immaterial for present purposes, some other material of construction is employed instead of metal for the tool) from the underground periphery 53 of each tool flight 52 than does the "SC" grinding; it being almost invariable for most sharpening purposes utilizing forward shank-to-nose tool passage that abrasive band 41 acts directly on the majority of the surface removal encountered and done even if some of its grinding action is subsequently further undercut by the following action of narrower band 42. As pointed out, narrower band 42 generally serves with a forwardly-passed tool to only in effect "knock off", as it were, the "HL" portion of the flight so as to put the secondary relief, or "SC", feature therein. Obviously and as has been brought out, if a rearwardly-moving passage is made of the tool or if the wheel in placement with a forwardly moving tool is reversed 180° to have narrower band 41 make first-towards-the-shank contact, the wheel is in effect set (especially when the hereinafter-explained tilting procedure is used) to have the bulk of cutting done by the wider band 41 for "SC"-making purposes with the then less voluminous "PR" cut taken by narrower band 42.

Now then, both of the bands 41 and 42 are grinding and working from the wheel with at least about the same force and under the same urging. However, unless proper compensations are made for effective work areas involved, the unit pressure on each band may well not be the same. Since it has to and must grind more away, the wearing and erosive influences are markedly greater on the greater-volume-cut-making wider band 41 (whether this be for "PR" with a forward moving tool wherein some of the "SC" is also taken or for "SC" with a rearward moving tool with the then smaller "PR" cutting done by narrower band 42) than on the narrower band 42 taking the smaller quantity of material out of the tooth profile. Unless different hardness abrasives were used in the separate bands (an extremely delicate and difficult to balance resort), the bands would wear quite unevenly if they were more readily and practically made of the same abrasive and provided in equal widths. This, of course, would cause wasteful and ineffectual wheel consumption and expenditure since, as has been mentioned, the "WD" should be and stay constant in both bands throughout the life of the wheel in intended sharpening service. And, if either band wore away sooner than the other (whether or not primarily affecting "PR" or "SC" provision due to tool passage direction), the resulting difference in "WD" between bands would disrupt the wheel and cause poor, if at all acceptable, results to be gotten in the sharpening operation.

This, however, is avoided and precluded in practice of the present invention by having unequal band widths in the separate bands of the split wheel assembly 25, with the commonly "PR"-making band 41 appropriately wider than the narrower band 42 employed commonly for the "SC" relief grinding. In this way, also beneficially allowing for their fabrication to be of the same abrasive material of construction, the bands 41, 42 wear at the same rate and the entire wheel 25 keeps a satisfactorily constant overall OD for efficient and prolonged, constantly good-sharpening use periods.

Further concerning the unequal band widths "BBT" and "SBT" (and again looking at FIG. 12), care should be taken that the trailing, rearwardly-effective narrower band 42 (when forward tool passage is practiced) is not so wide as might tend to interfere with flights going through or past the wheel; this being especially the case when multi-toothed tools (such as those that may have as many as 10 or 12 closely-spaced fluted flights as can be handled) are being sharpened in practice of the present invention.

FIG. 14 of the Drawing also brings out and develops another very advantageous feature and capability to incorporate in and/or with wheel assembly embodiments employed in practice of the invention. This, of especial utility and advantage with rearwardly-directed tool feeding, is the adaptation of the split abrasive grinding wheel 25 (or cup-like wheels 65 as later herein described) to be tiltable from the ordinarily vertical disposition thereof. For disk-form wheels 25, this disposition is that in which the wheel stands erect perpendicular with its side faces 37 at right angles to the center line **51*c*** of the tool being dressed to a slightly slanted position, pivoted as it were, about general tangent point "TG" in a direction either towards or away from the tool shank "S" or with or against the "TM" direction.

As shown in FIG. 14, the perpendicularly upright wheel 25 lies in a plane of ordinary position that is at an angle which is generally substantially about, if not exactly, 90° from the center line **51*c* of tool 51; this working disposition being angularly measurable between wheel and tool as indicated by ∟"WT". When wheel 25 is tilted in a direction slanted towards shank "S" of tool 51 and against the "TM" direction, it assumes an off-vertical rearward (in respect of the tool) angle ∟"TS". Its positioning is then such that its total angulation past vertical as taken from the tool center line 51*c* at the nose end "N" of the tool is equal to the summation of ∟"WT" + ∟"TS". When oppositely tilted (i.e., leaning towards the nose and in the "TM" direction with a forwardly-feeding tool) it is inclined at ∟"TN" with its total angulation ahead of vertical as taken from tool nose center line location being ∟ "WT" − ∟ "TN". As pointed out, wheel tilting is particularly useful to facilitate reversed, in effect, "PR" and "SC" cutting by wider and narrower bands 41, 42 (despite the fact that wider band 42** always removes more material and does the heavier grinding) when nose-to-shank moving, rearwardly-feeding tool advance is made to the wheel so that "TM" is the opposite of the direction shown in all views wherein it is illustrated in the Drawing. The tilt, as is readily imagineable, gives a somewhat more improved grinding approach for the bands on the portion of the tooth profile being taken away by either given band.

The wheel tilt effected for either ∟"TS" or ∟"TN" may be as much as 5° or so. Usually at least a 1° incline is made; with an advantageous angulation range for most purposes lying between about 2° and about 3° more or less than (or from) ∟"WT".

While either forward (viz., using ∟ "TN" in the "TM" direction of tool feed when shank-to-nose passage is done) or backward tilting is utilizable for achievement of different specific changed and increased relief angle and/or material excavation proportion or even other effects in the helix tool sharpening, as is also aterable by changes in tool feed direction, the ∟ "TN" wheel-inclining adjustment is particularly useful in the dressing of tools designed to have a rearwardly-disposed "CE" on the tooth (as in the widely-employed "R.H.Hlx./R.H.Ce" styles of end mills). One of the fundamental things thereby accomplished is to make a most effective compensation in wheel action during sharpening and material removals associated therewith to get, in properly calibrated construction outlines, the "CE" positioned towards the shank end of the tool. The tilted wheel, by means of its ability to change peripheral land surface dimensions with given wheel tangent point settings for dressing a given tool, provides a very fine control over the desired securement of proper ∟'s "PR"& "SC" and "PRW" plus land surfaces **54*p* and 54*s***. In this, as is evident in and from the foregoing, close control of relief angle cuttings facilitates getting the generally advantageous and wanted more narrow "PRW" since it permits. regardless of which sequence utilized for its accomplishment, the taking of a relatively larger cut-off in the heel portion "HL" of the tool tooth when making "SC" provision therein.

The advantageous cup-form embodiment variations of split abrasive band wheels in accordance with the invention have been brought out and touched upon in the foregoing. These are now more specifically illustrated and discussed with particular reference to FIGS. 18–22, inclusive, of the Drawing, wherein the shown cup-like wheels 65 can be observed to have the essential split abrasive band features and elements as are present in the disk-form wheels of the invention. While different in construction, these are basically the same as to function and result. The abrasive bands of the cup-form wheels 65 rotate about a vertically-extending center line **65*c* which is the center line of the cup 65 and lies generally perpendicular to center line 51*c* of tool 51. The split abrasive bands 41, 42 in the cup-like wheels 65 are in a washer-like array or manner of construction, reposing flatly disposed about the annular, concentric, open end of the cup. When forward-feeding shank-to-nose passage of the tool is to be done, the wider band 41 is situate exterior of the narrower interior band 42 and contiguous with the greatest OD at the open end of cup wheel 65. The contrary holds true (i.e., narrower band outermost—a construction not shown in the Drawing) when rearward nose-to-shank tool feed is to be done in the grinding. The cup-form wheels thus operate with the abrasive bands rotating in a grinding plane in which they reside that is parallel to the helix tool center line 51*c*. One result of such divergent sharpening action (compared to that with the disk wheels) is that the cuts obtained tend to be very slightly convexly-formed and delineated across the tooth profile on relieved land surfaces 54*p* and 54*s* with respect to tool center line 51*c* instead of the concavely-bent sort of excavation taken by a disk-like wheel 25**.

The reason for the convexly-cut effect, of course, is that the action of the flatly-passing abrasive bands in a cup wheel 65 does not dig into the unground peripheral surface 53 of the tool tooth flights in the same circumferentially-acting and -depressing, round-forming ways as with a disk wheel 25. In operation of a cup wheel 65, by the way, the above-described (in connection with FIG. 14) tilting procedures can be readily and most advantageously and satisfactorily done simply, as previously indicated, by making the desired angulation of center line **65*c* with tool center line upon forward or backward adjustment of ∟ "CT" (depicted in FIG. 21 and the equivalent of ∟ "WT" shown in FIG. 14), ∟ "CT" being the inter-center lines 90° angle when wheel 65** is in untilted posture.

Regardless of whether the cup wheel 65 has a tapered side wall and a somewhat "bell-like" configuration (as drawn out in FIGS. 18 and 19) or concentric, generally cylindrical flat walls and a somewhat "cap-like" configuration (as drawn out in FIG. 20), it is provided with the split abrasive annular bands 41 and 42 separated by gap 32 at the annular end opening of the cup. These are positioned at termination of the circular side wall portion 66 of the cup wheel 65 which extends, as side wall structure, from the abrasive bands to the top or back support wall 67 of the cup. For mounting purposes, the cup back wall 67 is generally provided with a central arbor hole 27. To assist in mounting and as is shown in FIG. 20, satellite thread taps 69 (or the like or equivalent auxiliary mounting accessory provisions) may be put along concentric center lines **69*c* therefore in back wall 67 spaced out from arbor hole 27** therein.

The operation and action of a cup wheel 65 for tool sharpening is evident in analysis of FIGS. 21 and 22. In the running of a cup-form of wheel embodiment in accordance with and practice of the present invention, by the way, it is important to avoid any possibility of grinding interference that the selected cup diameter at the point of smallest opening within the plane of the abrasive band(s) placement be greater (or longer) than the length of the flute in the helix tool to be sharpened.

Thus, use of a cup-form wheel in practice of the present invention also bears many advantages and benefits; these including:

(1) The ability of the cup wheel to also readily control "PRW", "PR" and "SC" requirements, especially when and if wheel "tilting" is practiced with the use thereof;

(2) Within the scope of ordinary use for most tool dressing purposes, especially when appropriate tilting adjustments are involved, the aptitude of the same cup wheel to be generally capable of back-off sharpening of either tools with "R.H.Hlx./R.H.CE" characteristics or those with "L.H.Hlx./L.H.L.CE" features, or both; with only slightly more adjustment then usually needed to utilize the same cup wheel with and for dressing of both "L.H.Hlx./R.H.CE" and "R.H.Hlx./L.H.CE" tools;

(3) The easy capability of a cup wheel to sharpen very fine diameter helix tools, such as end mills with "TD" of 0.020" and less; as well as the excellent adaptability of the cup wheel to dress tools in simultaneously applied double back-off fashion even when the tools are designed with a plurality of more than five teeth flight in the construction, and (4) Excellent wearing and longevity characteristics of the cup wheel embodiments.

In actual use operation of various split abrasive wheel embodiments in accordance with the present invention for sharpening various types and sizes of commercial end mills, the dressing time over long periods of tool grinding has (depending to some extent and varying with particular tools being dressed) been reduced with excellent product results on a scale of from 30% to 60% less time requirement than that involved for doing the same thing by the old-fashioned, two-step conventional technique. The advantage and material labor and other savings in this needs no particular elaboration for appreciation of the value and merit in and obtainable from practice of the present invention.

Many changes and modifications can readily be made and adapted in embodiments and practices in accordance with the present invention without substantially departing from its apparent and intended spirit and scope, all in pursuance to and accordance with same as it is set forth and defined in the hereto-appended claims.

What is claimed is:

1. A double-banded, split abrasive wheel for the sharpening by abrading grind dressing of helix tools, said wheel being characterized in its unique adaptability and capability of accomplishing in a single, simultaneously-performable, one-pass operation to impart completely in the peripheral surface of teeth flight(s) of the tool being sharpened the appropriate desired primary relief surface both as to width and angulation from the intended cutting edge of the tool and the appropriate desired secondary clearance surface leading to the heel of the tooth profile and broken away from and more highly angulated than said primary relief surface;

said wheel comprising as an apparatus combination:

(a) a generally circular central support member having a round peripheral edge that is spaced from and coaxial with the central axis center line of rotation of the wheel;

(b) a pair of constantly-layered, continuously-uninterrupted, equally- and uniformly-thick, abrasive bands split so as to be substantially disproportionate in width and mounted side-by-side on the peripheral edge of said central support member (a) and coaxial with said axial center line of said support member;

each of the bands in said pair (b) of abrasive bands having essentially the same abrading hardness; so that (c) each of said pair of abrasive bands (b) has an exposed, continuous and integral effectively at least about equivalent grinding surface face thereon relevant to grind dressing capability;

(d) each of said pair of abrasive bands (b) having an independently and distinct uniform width, the determining side edges of which limit the grinding face(s) (c) thereof; with (e) the grinding surface face (c) of each of said abrasive bands (b) being distendingly disposed with a lay in the same line passing generally in crossing traverse contact and running across said respective and aligned faces of both bands;

(f) a gap of softer material including the material of said central support member (a) separating and uniformly spacing said pair of split abrasive bands (b) between one of the laterally-extending width edges (d) thereof of each of said pair in the mounted placement position of said bands about central support member (a);

(g) the width of the first one of said bands in said pair (b) which for application of forward shank-to-nose tool feeding to be sharpened with said wheel is intended and adapted to initially contact and form the cutting edge and provide material removal for primary relief from and into the tooth projection(s) of of a helix tool being passed into contact for its sharpening by means of said wheel being relatively wider than (h) the width of the relatively narrower second one of said bands in said pair (b) which, also in forward tool-feeding application, is intended and adapted to immediately subsequently contact and cut secondary relief and angulation after initial action by said first band on said tooth projection(s) of said helix tool; and with and wherein the width of said wider band (g) is between about one-and-one-half-times ($1\frac{1}{2}$) and about four-times ($4\times$) that of said narrower band (h); so that as a further characterizing feature of the wheel the rate of wear experienced as a result of abrading grind dressing sharpening action by said abrasive wheel on a helix tool is substantially the same insofar as concerns respective thickness reductions encountered after any given period of usage in both said wider band (g) and said relatively narrower second band (g) in said pair (b) of abrasive bands in said wheel.

2. A split abrasive wheel apparatus combination in accordance with that of claim 1, wherein said wheel is embodied in a disk-like form.

3. A split abrasive wheel apparatus combination in accordance with that of claim 1, wherein said wheel is embodied in a cup-like form.

4. The disk-like form of split abrasive wheel of claim 2, wherein each of said abrasive bands in said pair (b) has a ring-like configuration with a flat width greater than the thickness distance between their inner diameter (I.D.) and outer diameter (O.D.) thereof;

each of said pair (b) being mounted in flat side-by-side alignment on and around the cylindrical circumferential edge periphery of said generally circular and disk-like support member (a).

5. A disk-like form of split abrasive wheel in accordance with that of claim 4 and including, in addition thereto and in combination therewith:

(i) a web-like ridge extension of the discoid central support member (a) which extends intermediately out of and above the cylindrical circumferential peripheral edge surface thereof and runs concentrically about said periphery.

said ridge extension (i) extending at least partially up and between the thickness of the adjacently spaced pair of abrasive bands (b) so as to (k) form a radially-extending peripheral encircling gap therebetween and provide lateral support for each of said pair of bands (b).

6. The cup-like form of split abrasive wheel of claim 3, wherein each of said abrasive bands in said pair (b) has an annular, washer-like configuration with a flat width from I.D. to O.D. greater than the radially-extending, cylindrically planar thickness thereof;

the I.D. of said water band (g) being greater than the O.D. of said narrower band (h); with each of said pair (b) being mounted in flat, radially-outwardly-spaced side-by-side alignment on and around the annular, radially-flat circumferential edge periphery at the opening of said generally circular and cup-like support member (a).

7. The cup-like form of split abrasive wheel of claim 3, wherein each of said abrasive bands in said pair (b) has an annular, washer-like configuration with a flat width from I.D. to O.D. greater that the radially-extending, cylindrically planar thickness thereof;

the O.D. of said wider band (g) being lesser than the I.D. of said narrower band (h); with each of said pair (b) being mounted in flat, radially-outwardly-spaced side-by-side alignment on and around the annular, radially-flat circumferential edge periphery at the opening of said generally circular and cup-like support member (a).

8. A cup-like form of split abrasive wheel in accordance with that of claim 6 and including, in addition thereto and in combination therewith:

(j) a web-like ridge extension of the cup-shaped central support member (a) which extends intermediately out of and coaxially therewith about the annular, radially-flat peripheral edge surface thereof and runs circularly around said periphery between the I.D. and O.D. edges thereof;

said ridge extension (j) jutting at least partially up and between the thickness of the adjacently spaced pair of abrasive bands (b) so as to (k) from a cylindrically-extending peripheral encircling gap therebetween and provide lateral support for each of said pair of bands (b).

9. A wheel apparatus combination in accordance with that of claim 8 inclusive, wherein the width of said wider band (g) is between about 60% and about 80% of the total summation of the width of said wider band plus the width of said narrower band (h).

10. A wheel apparatus combination in accondance with that of claim 9, wherein the width of said wider band (g) is about three-times (3×) the width of said narrower band (h).

11. A wheel apparatus combination is accordance with any one of those of claims 4–10, inclusive, wherein the overall O.D. at the peripheral grinding surface of said wheel is between about 1½ and about 8 inches.

12. A wheel apparatus combination in accordance with claim 5, wherein the spaced gap (k) width between adjacent abrasive bands in said pair (b) is between about 5% and about 20% of the summation of the total width of said gap width plus the width of said wider band (g) plus the width of said narrower band (h).

13. A wheel apparatus combination in accordance with that of claim 12, wherein the overall O.D. at the peripheral grinding surface of said wheel is about 1½ inches; and the total summation of the respective widths of said wider band (g), narrower band (h) and said gap (k) is an an overall width that is between about 0.0625" and about 0.125".

14. A wheel apparatus combination in accordance with any one of those of claims 4–10, 12 inclusive, wherein said wheel is adapted to be tilted backward or forward in the direction intended for the tool to be sharpened to be passed in grinding contact therewith, said tiltability being out of the normally vertically upright disposition of said wheel with respect to the intended passage direction of said tool to be sharpened.

15. A wheel apparatus combination in accordance with that of claim 14, wherein said wheel is adapted to be tilted to an angle of up to about 5°.

16. A wheel apparatus combination in accordance with that of claim 14, wherein said wheel is adapted to be tilted to an angled inclination that is between about 2° and about 3°.

17. A cup-like form of split abrasive wheel in accordance with that of claim 7 and including, in addition thereto and in combination therewith:

(j) a web-like ridge extension of the cup-shaped central support member (a) which extends intermediately out of and coaxially therewith about the annular, radially-flat peripheral edge surface thereof and runs circularly around said periphery between the I.D. and the O.D. edges thereof;

said ridge extension (j) jutting at least partially up and between the thickness of the adjacently-spaced pair of abrasive bands (b) so as to (k) form a cylindrically extending peripheral-encircling gap therebetween and provide lateral support for each of said pair of bands (b).

18. A wheel apparatus combination in accordance with that of claim 4, wherein the width of said wider band (g) is between about 60% and about 80% of the total summation of the width of said wider band plus the width of said narrower band (h).

19. A wheel apparatus combination in accordance with that of claim 5, wherein the width of said wider band (g) is between about 60% and about 80% of the total summation of the width of said wider bland plus the width of said narrower band (h).

20. A wheel apparatus combination in accordance with that of claim 6, wherein the width of said wider band (g) is between about 60% and about 80% of the total summation of the width of said wider band plus the width of said narrower band (h).

21. A wheel apparatus combination in accordance with that of claim 7, wherein the width of said wider band (g) is between about 60% and about 80% of the total summation of the width of said wider band plus the width of said narrower band (h).

22. A wheel apparatus combination in accordance with that of claim 17, wherein the width of said wider band (g) is between about 60% and about 80% of the total summation of the width of said wider band plus the width of said narrower band (h).

23. A wheel apparatus combination in accordance with that of claim 18, wherein the width of said wider band (g) is about three-times (3×) the width of said narrower band (h).

24. A wheel apparatus combination in accordance with that of claim 19, wherein the width of said wider band (g) is about three-times (3×) the width of said narrower band (h).

25. A wheel apparatus combination in accordance with that of claim 20, wherein the width of said wider band (g) is about three-times (3×) the width of said narrower band (h).

26. A wheel apparatus combination in accordance with that of claim 21, wherein the width of said wider band (g) is about three-times (3×) the width of said narrower band (h).

27. A wheel apparatus combination in accordance with that of claim 22, wherein the width of said wider band (g) is about three-times (3×) the width of said narrower band (h).

28. A wheel apparatus combination in accordance with that of claim 7, wherein the spaced gap (k) width between adjacent abrasive bands in said pair (b) is between about 5% and about 20% of the summation of the total width of said gap width plus the width of said wider band (g) plus the width of said narrower band (h).

29. A wheel apparatus combination in accordance with that of claim 8, wherein the spaced gap (k) width between adjacent abrasive bands in said pair (b) is between about 5% and about 20% of the summation of the total width of said gap width plus the width of said wider band (g) plus the width of said narrower band (h).

30. A wheel apparatus combination in accordance with that of claim 17, wherein the spaced gap (k) width between adjacent abrasive bands in said pair (b) is between about 5% and about 20% of the summation of the total width of said gap width plus the width of said wider band (g) plus the width of said narrower band (h).

31. A wheel apparatus combination in accordance with that of claim 11, wherein said wheel is adapted to be tilted backward or forward in the direction intended for the tool to be sharpened to be passed in grinding contact therewith, said tiltability being out of the normally vertical upright disposition of said wheel with respect to the intended passage direction of said tool to be sharpened.

32. A wheel apparatus combination in accordance with that of claim 31, wherein said wheel is adapted to be tilted to an angled inclination that is between about 2° and about 3°.

33. A split abrasive wheel device in apparatus form that is in accordance with that of claim 1, wherein the particle size form of the abrasive grit and the general hardness as well as the abrading capability and the resistance to wear during grind dressing applications thereof on and for helix tool and the like sharpening operations of of both of the abrasive bands in said pair (b) of such bands are for practical purposes identical in both thereof.

34. A split abrasive wheel device in disk-like apparatus form that is in accordance with that of claim 2, wherein the particle size form of the abrasive grit and the general hardness as well as the abrading capability and the resistance to wear during grind dressing applications thereof on and for helix tool and the like sharpening operations of both of the abrasive bands in said pair (b) of such bands are for practical purposes identical in both thereof.

35. A split abrasive wheel device in cup-like apparatus form that is in accordance with that of claim 3, wherein the particle size form of the abrasive grit and the general hardness as well as the abrading capability and the resistance to wear during grind dressing applications thereof on and for helix tool and the like sharpening operations of both of the abrasive bands in said pair (b) of such bands are for practical purposes identical in both thereof.

36. Method of single-stage, one-step sharpening of helix tools, including end mills, comprising the Step of:

(1) taking an unground, pre-formed helix tool having a nose end and a shank end and spiral tooth flight(s) therebetween;

(2) slowly twist-feeding said helix tool by rotating it about its center line axis of rotation and passing it longitudinally by and laterally against the aapparatus combination, said wheel being a double-banded, split abrasive wheel for the sharpening by abrading grind dressing of helix tools and which is characterized in its unique adaptability and capability of accomplishing in a single, simultaneously-performable, one-pass operation to impart completely in the peripheral surface of teeth flight(s) of the tool being sharpened the appropriate desired primary relief surface both as to width and angulation from the intended cutting edge of the tool and the appropriate desired secondary clearance surface leading to the heel of the tooth profile and broken away from and more highly angulated than said primary relief surface, said wheel being comprised of:

(a) a generally circular central support member having a round peripheral edge that is spaced from and coaxial with the central axis center line of rotation of the wheel;

(b) a pair of constantly-layered, continuously-uninterrupted, equally- and uniformly-thick, abrasive bands substantially disproportionate in width and mounted side-by-side on the peripheral edge of said central support member (a) and coaxial with said axial center line of said support member;

(c) each of said pair of abrasive bands (b) having an exposed, continuous and integral effectively at least about equivalent grinding surface face thereon relevant to grind dressing capability;

(d) each of said pair of abrasive bands (b) having an independently and distinct uniform width, the determining side edges of which limit the grinding face(s) (c) thereof;

(e) the grinding face (c) of each of said abrasive band (b) distendingly disposed with a lay in the same line passing generally in crossing traverse contact over and running across said respective and aligned faces of both bands;

(f) a gap of softer material including the material of said central support member (a) separating and uniformly spacing said pair of split abrasive bands (b) between one of the laterally-extending width edges (d) thereof of each of said pair in the mounted placement position of said bands about said central support member (a);

(g) the width of the first one of said bands in said pair (b) which for application of forward shank-to-nose tool feeding to be sharpened with said wheel is intended and adapted to initially contact and form the cutting edge and provide material removal for primary relief from and into the tooth projection(s) of a helix tool being passed into contact for its sharpening by means of said wheel being relatively wider than (h) the width of the relatively narrower second one of said bands in said pair (b) which, also in forward tool-feeding application, is intended and adapted to immediately subsequently contact and cut secondary relief and angulation after initial action by said first band on said tooth projection(s) of said helix tool;

(3) setting said wheel with respect to said tool so that its wider band (g) makes first cutting contact contact with said passing tool so as to initially excavate the greater proportion of material to be removed from the tooth profile of the tool being sharpened in order to form at least the bulk of one of the peripheral relief surfaces and associated peripheral relief angle on the tooth flight(s) of said tool; and so that after which in immediate subsequent sequence (4) said narrower band (h) setting of said wheel is such that it makes following cutting contact taking a lesser proportion of remaining tooth profile material in excavation to complete the peripheral relief surfaces and associated peripheral relief angle on said tooth flight(s); during which time there is carried out (5) rapid, power-driven, grinding rotation of said wheel; then (6) withdrawing the thereby completely dressed and finished tool from grinding contact with said wheel.

37. In the method of claim 36:

feeding said tool forwardly in a shank-to-nose direction into said wheel whereby said wider band (g) makes first cutting contact with the passing tool so as to initially form the cutting edge and peripheral relief surface at the associated peripheral relief angle on the tooth flight(s) of said tool; so that after which in immediate subsequent sequence said narrower band (h) by virtue of the setting of said wheel makes following cutting contact for the secondary clearance surface and increased angulation thereof on said tooth flight(s).

38. In the method of claim 36:

feeding said tool rearwardly in a nose-to-shank direction into said wheel whereby said wider band (g) makes first cutting contact with the passing tool so as to initially form the secondary relief outlines and greater angulation associated therewith in at least the heel portion of the tool flight of said tooth flight(s) of said tool; so that after which in immediate subsequent sequence said narrower band (h) by virtue of the setting of said wheel makes following cutting contact for the primary relief surface and lesser angulation thereof leading into and making the cutting edge for said tool on said tooth flight(s).

39. The method of claim 36 when so operated that the turning directions of said rotating tool and wheel are opposite going one into another.

40. The method of claim 36 when performed so that selection of said wheel is made for it to have an O.D. at its peripheral grinding edge that is between about $2\frac{1}{2}\times$ and about $75\times$ the diameter of the tool being sharpened.

41. The method of claim 36 when so conducted that the wheel is tilted from its normally upright vertical position with respect to the center line of the tool being sharpened to an inclined angle of up to about 5° from said vertical position causing correspondingly slight non-parallelism in the relative respective matching alignment between the flat grinding edge of the wheel and the unground peripheral land surface on the teeth flight(s) of the tool being sharpened.

42. Running the method of claim 41 by setting said angle of wheel tilt between about 2° and about 3°.

43. The method of claim 36 when performed after pre-selection of a split abrasive wheel for utilization therein that has a total width across its entire grinding abrasive peripheral edge, including both of the pair of abrasive bands (b) therein, which is of a magnitude that is between about $30\times$ and about $500\times$ the lateral peripheral width of the spiral tooth flight(s) on said helix tool to be sharpened; said relative magnitude increasing in approximate proportion to decreasing diameter in said tool pre-selected to be dressed.

44. Using a disk-like form of double-banded, split abrasive wheel in Step (2) and elsewhere in practice of the method of claim 36.

45. Using a cup-like form of double-banded, split abrasive wheel in Step (2) and elsewhere in practice of the method of claim 36.

46. A method in accordance with any one of the methods of claims 37 43, 44 45 inclusive, and including, in addition thereto and combination therewith:

the simultaneous further Step in conjuction with said Step (3) of, as associated Step (7)

setting said wheel with respect to said tool so that said wheel is tilted relatively backward in the direction intended for the tool to be sharpened with respect to the normally vertically upright disposition of said wheel relevant to the intended passage direction of said tool, with the angled setting of said wheel being made at a tilt angle of up to about 5°.

47. A method in accordance with any one of the methods of claims 36–42,44 or 45, inclusive, and including, in addition thereto and combination therewith:

the simultaneous further Step in conjunction with said Step (3) of, as associated Step (7)

setting said wheel with respect to said tool so that said wheel is tilted relatively forward in the direction intended for the tool to be sharpened with respect to the normally vertical upright disposition of said wheel relevant to the intended passage direction of said tool, with the angled setting of said wheel being made at a tilt angle of up to about 5°.

48. A method in accordance with that of claim 36 and including, in addition thereto and combination therewith:

the simultaneous further Step in conjunction with said Step (3) of, as associated Step (7)

setting said wheel with respect to said tool so that said wheel is tilted relatively backward in the direction intended for the tool to be sharpened with respect to the normally vertical upright disposition of said wheel relevant to the intended passage direction of said tool, with the angled setting of said wheel being made at a tilt angle of up to about 5°.

49. A method in accordance with that of claim 36 and including, in addition thereto and combination therewith:

the simultaneous further Step in conjunction with said Step (3) of, as associated Step (7)

setting said wheel with respect to said tool so that said wheel is tilted relatively forward in the direction intended for the tool to be sharpened with respect to the normally vertical upright disposition of said wheel relevant to the intended passage direction of said tool, with the angled setting of said wheel being made at a tilt angle of up to about 5°.

50. Practicing the method of claim 36 by utilizing in said Step (1) thereof for said double-banded, split abrasive wheel element for the said sharpening one in which the particle size form of the abrasive grit and the general hardness as well as the abrading capability and the resistance to wear during the said grind dressing operations in which said wheel is appled on and for the helix tool and the like sharpening Steps enumerated are as to said characteristics of said wheel are in each of the abrasive bands in said pair (b) of the wheel identical for practical purposes in both thereof.

* * * * *

UNITED STATES PATENT AND TRADEMARK OFFICE

CERTIFICATE OF CORRECTION

PATENT NO. : 4,442,637

DATED : April 17, 1984

INVENTOR(S) : Alexander Ahejew

It is certified that error appears in the above-identified patent and that said Letters Patent is hereby corrected as shown below:

At Column 6, Line 52, at the conclusion of the parenthetical passage and just ahead of the closing parenthesis setting off same, strike out the meaningless letter sequence "ated" and replace it with the full and proper passage as dis--closed which also includes a phrase in parentheses, namely and to wit -- the wider peripheral surface 34 of core 26. Conversely, web side face 39 resides over and in a plane normal to the nar--rower peripheral surface 35. In this way there is provided an accommodating support recess (not numerically or otherwise desig--nated) --;

At Column 9, Line 45, separate or hyphenate the words "hereto" and "annexed" in the term "hereto-annexed";

At Column 14, Line 53, correct the spelling of the word "their" (from the erroneously-given <u>ther</u>);

At Column 15, Line 13, replace the meaningless letters "ge" with the word -- be --;

At Column 17, Line 38, delete the small letter "l" from the sequence "lis" so that the proper word -- is -- appears at this point;

At Column 27 (in issued Claim 36): pluralize the word "Step" in Line 39 so that it appears correctly as -- Steps --; and (ii), at Line 45, correct the spelling of the word "apparatus" (which runs over into Line 46) by deleting of the first small letter "a" therein;

At Column 30, Line 56 (in issued Claim 50), correct the spelling of the word "applied" by inserting the small letter "i" between the letters "l" and "e" therein; and

UNITED STATES PATENT AND TRADEMARK OFFICE

CERTIFICATE OF CORRECTION

PATENT NO. : 4,442,637

DATED : April 17, 1984

INVENTOR(S) : Alexander Ahejew

It is certified that error appears in the above-identified patent and that said Letters Patent is hereby corrected as shown below:

The sheet of drawing consisting of FIG. 23 should be added as per the attached sheet.

Signed and Sealed this

*Eighteenth* Day of *June 1985*

[SEAL]

*Attest:*

DONALD J. QUIGG

*Attesting Officer*

*Acting Commissioner of Patents and Trademarks*

BASIC CORE SHAPES

SHAPES OF DIAMOND CROSS SECTION

EXAMPLE: Using specifications from the foregoing list, a number designating a typical diamond wheel shape could be arrived at as follows:

Analysis of a Typical Diamond Wheel Shape

The complete wheel shape number would be written: D6A2C.